US009898934B2

(12) United States Patent
Wang et al.

(10) Patent No.: US 9,898,934 B2
(45) Date of Patent: Feb. 20, 2018

(54) PREDICTION OF VEHICLE MANEUVERS

(71) Applicant: Honeywell International Inc., Morris Plains, NJ (US)

(72) Inventors: Guoqing Wang, Beijing (CN); Rong Zhang, Beijing (CN); Zhong Chen, Beijing (CN); Ruy C. Brandao, Redmond, WA (US); Yang Liu, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/219,235

(22) Filed: Jul. 25, 2016

(65) Prior Publication Data

US 2018/0025653 A1 Jan. 25, 2018

(51) Int. Cl.
*G08G 5/00* (2006.01)
*G08G 5/04* (2006.01)

(52) U.S. Cl.
CPC ..... *G08G 5/04* (2013.01)

(58) Field of Classification Search
None
See application file for complete search history.

(56) References Cited

U.S. PATENT DOCUMENTS 5,566,074 A 10/1996 Hammer
5,892,462 A * 4/1999 Tran ..... G01C 5/005 340/961
6,420,993 B1 7/2002 Varon
6,820,008 B1 11/2004 Patera
6,873,903 B2 3/2005 Baiada et al.
6,950,037 B1 9/2005 Clavier et al.
7,711,484 B2 5/2010 Hammarlund et al.
(Continued)

FOREIGN PATENT DOCUMENTS

CN 1161097 A 10/1997
CN 101996501 A 3/2011
(Continued)

OTHER PUBLICATIONS

"Chapter 3: Airspace," Aeronautical Information Manual, U.S. Department of Transportation, FAA, May 26, 2016, 67 pp.
(Continued)

*Primary Examiner* — Brent Swarthout
(74) *Attorney, Agent, or Firm* — Shumaker & Sieffert, P.A.

(57) ABSTRACT

A system is described that is configured to receive surveillance data from a vehicle, determine a location of the vehicle based at least in part on the received surveillance data, and determine a course of the vehicle based at least in part on the received surveillance data. The system is further configured to predict a future vehicle maneuver for the vehicle based at least in part on the location and the course of the vehicle, and based at least in part on a set of protocol data indicating one or more standard procedures for one or more vehicle maneuvers. The system is further configured to determine, based at least in part on the predicted future vehicle maneuver, a modified protection volume for the vehicle that is modified relative to a baseline protection volume for the vehicle. The system is further configured to generate an output based on the modified protection volume.

20 Claims, 13 Drawing Sheets

(56) References Cited

U.S. PATENT DOCUMENTS

| | | | |
|---|---|---|---|
| 7,835,866 | B2 | 11/2010 | Tzidon |
| 8,442,707 | B2 | 5/2013 | Ledesma et al. |
| 8,744,738 | B2 | 6/2014 | Bushnell |
| 2003/0107499 | A1 | 6/2003 | Lepere et al. |
| 2011/0282582 | A1 | 11/2011 | Stayton et al. |
| 2012/0158219 | A1 | 6/2012 | Durling et al. |
| 2012/0303252 | A1 | 11/2012 | Schwinn et al. |
| 2013/0317733 | A1 | 11/2013 | del Pozo de Poza et al. |
| 2013/0338909 | A1 | 12/2013 | de Blanes et al. |
| 2013/0338910 | A1 | 12/2013 | Vilaplana et al. |
| 2014/0052314 | A1 | 2/2014 | Ostrom et al. |
| 2014/0085124 | A1 | 3/2014 | Dusik et al. |
| 2015/0294573 | A1 | 10/2015 | Conner et al. |

FOREIGN PATENT DOCUMENTS

| | | | |
|---|---|---|---|
| CN | 104020681 | A | 9/2014 |
| EP | 1517281 | A2 | 3/2005 |
| EP | 1764759 | A1 | 3/2007 |
| EP | 2325825 | A2 | 5/2011 |
| EP | 2469291 | A1 | 6/2012 |
| JP | 4640806 | B2 | 3/2011 |
| WO | 2007123438 | A1 | 11/2007 |
| WO | 2016070349 | A1 | 5/2016 |

OTHER PUBLICATIONS

"Chapter 7: Airport Traffic Patterns," Airplane Flying Handbook, U.S. Department of Transportation, FAA, FAA-H8083-3A, 2004, 13 pp. (Applicant points out, in accordance with MPEP 609.04(a), that the year of publication, 2004, is sufficiently earlier than the effective U.S. filing date, Jul. 25, 2016, so that the particular month of publication is not in issue.).

"Chapter 9: Basic Flight Maneuvers," Rotorcraft Flying Handbook, U.S. Department of Transportation, FAA, FAA-H-8083-21, 2000, 31 pp. (Applicant points out, in accordance with MPEP 609.04(a), that the year of publication, 2004, is sufficiently earlier than the effective U.S. filing date, Jul. 25, 2016, so that the particular month of publication is not in issue.).

"Improved Ground Collision Avoidance System for General Aviation Aircraft and UAVs," Tech Briefs Media Group, Jan. 1, 2016, 2 pp.

Baek et al., "ADS-B Trajectory Prediction and Conflict Detection for Air Traffic Management," Technical Paper, International Journal of Aeronautical & Space Sciences, 2012, after accepted date of Aug. 24, 2012, vol. 13, No. 3, pp. 377-385. (Applicant points out, in accordance with MPEP 609.04(a), that the year of publication, 2004, is sufficiently earlier than the effective U.S. filing date, Jul. 25, 2016, so that the particular month of publication is not in issue.).

Carpenter et al., "Probability-based collision alerting logic for closely-spaced parallel approach," AIAA Meeting Papers on Disc, American Institute of Aeronautics and Astronautics, Inc., Jan. 1997, 9 pp.

Hwang et al., "Intent-Based Probabilistic Conflict Detection for the Next Generation Air Transportation System," Proceedings of the IEEE, vol. 96, No. 12, Dec. 2008, 23 pp.

Kochenderfer et al., "Next-Generation Airborne Collision Avoidance System," Lincoln Laboratory Journal, vol. 19, No. 1, 2012, 17 pp. (Applicant points out, in accordance with MPEP 609.04(a), that the year of publication, 2004, is sufficiently earlier than the effective U.S. filing date, Jul. 25, 2016, so that the particular month of publication is not in issue.).

Maeder et al., "Trajectory Prediction for Light Aircraft," Journal of Guidance, Control, and Dynamics, vol. 34, No. 4, Jul.-Aug. 2011, 8 pp.

U.S. Appl. No. 14/702,334 by Honeywell International Inc. (Inventors: Vernon J. Van Steenkist et al.), filed May 1, 2015.

U.S. Appl. No. 14/886,982 by Honeywell International Inc. (Inventors: Guoqing Wang et al.), filed Oct. 19, 2015.

Xu, "TCAS/ADS-B Integrated Surveillance and Collision Avoidance System," Proceedings of the 2nd International Conference on Computer Science and Electronics Engineering, Mar. 22-23, 2013, pp. 666-669.

Extended European Search Report from counterpart European Application No. 17181084.9, dated Nov. 15, 2017, 5 pp.

* cited by examiner

PREDICTION OF VEHICLE MANEUVERS

TECHNICAL FIELD

This disclosure relates to collision prevention in aviation.

BACKGROUND

Air traffic control systems track positions and velocity of aircraft and help manage aircraft trajectories. Air traffic control may be based on radar surveillance, supplemented more recently with cooperative radio surveillance techniques, such as automatic dependent surveillance-broadcast (ADS-B). An aircraft may determine its own position, such as via a Global Navigation Satellite System (GNSS), and periodically broadcast its position via a radio frequency, which may be read by ground stations and other aircraft. Aircraft position data may be provided to a variety of other applications that serve functions such as traffic situational awareness, traffic alert, and collision avoidance, for example.

SUMMARY

This disclosure is directed to systems, devices, and methods for generating air traffic alerts. A system of this disclosure may predict a future vehicle maneuver based at least in part on the location and course of a vehicle. The predicted future vehicle maneuver may be a turn or a change in altitude. The system may also use a set of protocol data for standard procedures, such as national or international aviation regulations, to predict the future vehicle maneuver. The system may use the predicted future vehicle maneuver to modify a baseline protection volume for the vehicle. For example, the modified protection volume may extend in the direction of a predicted turn or change in altitude.

In one example, a system is configured to receive surveillance data from a vehicle, determine a location of the vehicle based at least in part on the received surveillance data, and determine a course of the vehicle based at least in part on the received surveillance data. The system is further configured to predict a future vehicle maneuver for the vehicle based at least in part on the location and the course of the vehicle, and based at least in part on a set of protocol data indicating one or more standard procedures for one or more vehicle maneuvers. The system is further configured to determine, based at least in part on the predicted future vehicle maneuver, a modified protection volume for the vehicle that is modified relative to a baseline protection volume for the vehicle. The system is further configured to generate an output based on the modified protection volume.

In another example, a method includes receiving surveillance data from a vehicle, determining a location of the vehicle based at least in part on the received surveillance data, and determining a course of the vehicle based at least in part on the received surveillance data. The method further includes predicting a future vehicle maneuver for the vehicle based at least in part on the location and the course of the vehicle, and based at least in part on a set of protocol data indicating one or more standard procedures for one or more vehicle maneuvers. The method further includes determining, based at least in part on the predicted future vehicle maneuver, a modified protection volume for the vehicle that is modified relative to a baseline protection volume for the vehicle and generating an output based on the modified protection volume.

Another example is directed to a system comprising means for receiving surveillance data from a vehicle. The system further comprises means for determining a location of the vehicle based at least in part on the received surveillance data and means for determining a course of the vehicle based at least in part on the received surveillance data. The system further comprises means for predicting a future vehicle maneuver for the vehicle based at least in part on the location and the course of the vehicle, and based at least in part on a set of protocol data indicating one or more standard procedures for one or more vehicle maneuvers. The system further comprises means for determining, based at least in part on the predicted future vehicle maneuver, a modified protection volume for the vehicle that is modified relative to a baseline protection volume for the vehicle and means for generating an output based on the modified protection volume.

The details of one or more examples are set forth in the accompanying drawings and the description below. Other features, objects, and advantages will be apparent from the description and drawings, and from the claims.

DETAILED DESCRIPTION

Various examples are described below generally directed to devices, systems, and methods for aircraft maneuver prediction, and protection volumes airspace violations based at least in part on the aircraft maneuver prediction. The aircraft maneuver prediction by a system of this disclosure may include predicting future aircraft trajectories based at least in part on any of a wide variety of air traffic protocols or other sources of air traffic information, as further described below. The system may then modify a baseline protection volume based at least in part on a predicted future aircraft maneuver.

Figure 1:
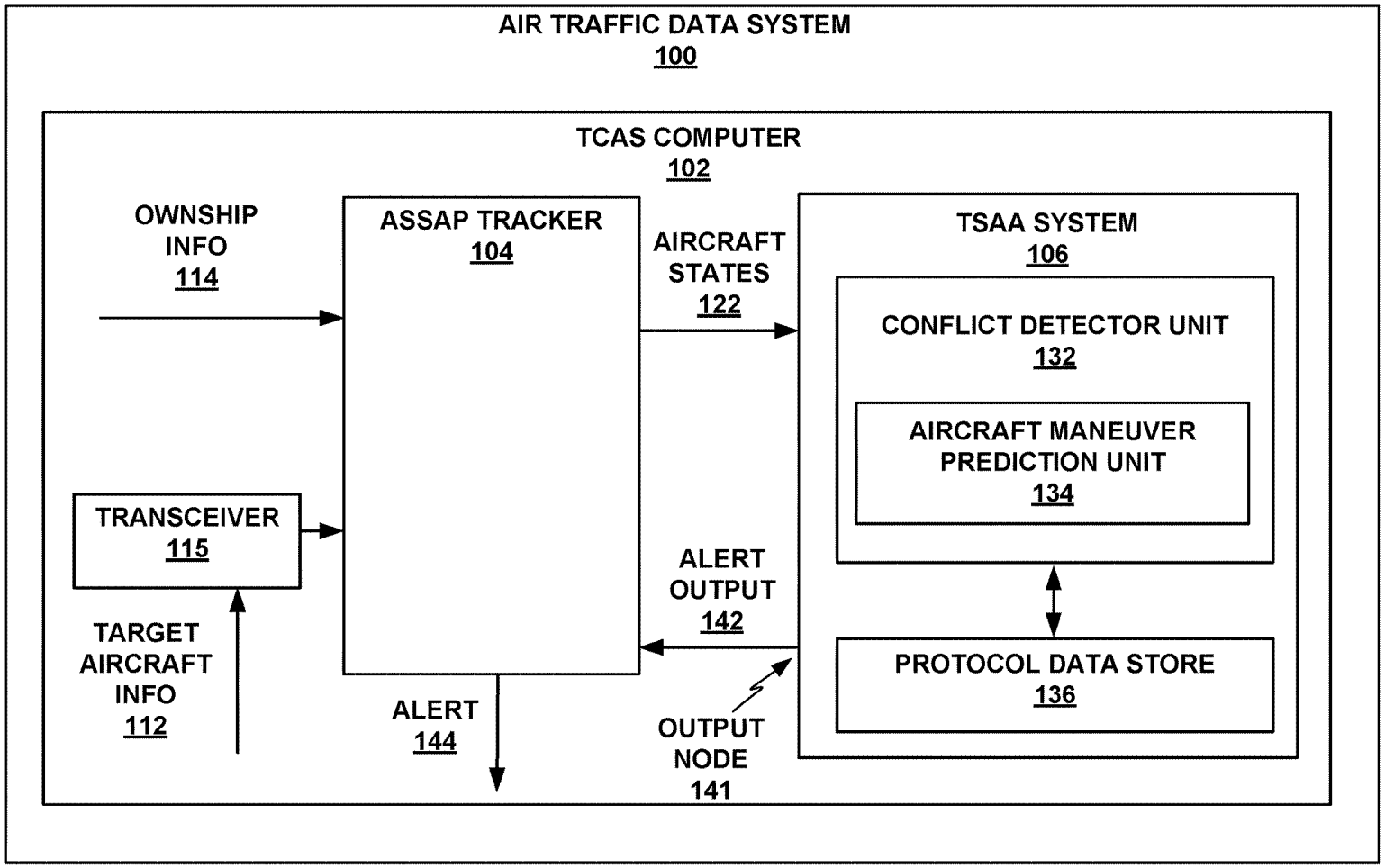
FIG. 1 depicts a conceptual block diagram of an example air traffic data system that includes a Traffic Collision Avoidance System (TCAS) computer.

FIG. 1 depicts a conceptual block diagram of an example air traffic data system 100 that includes a Traffic Collision Avoidance System (TCAS) computer 102. Air traffic data system and TCAS computer 102 may be incorporated as part of the avionics on an aircraft, or may be implemented in a ground station, in various examples. Although described in terms of aircraft, the principles of this disclosure applies to all vehicles, including land vehicles such as automobiles and water vehicles such as ships. TCAS computer 102 includes an Airborne Surveillance and Separation Assurance Processing (ASSAP) tracker 104 and Traffic Situation Awareness and Alert (TSAA) system 106. ASSAP tracker 104 may receive (also referred to herein as collect) surveillance data regarding an ownship and other aircraft. TSAA system 106 includes a conflict detector unit 132 including aircraft maneuver prediction unit 134. Aircraft maneuver prediction unit 134 may predict future aircraft maneuvers based at least in part on surveillance data any of a wide variety of air traffic protocols or other sources of air traffic information. Aircraft maneuver prediction unit 134 may also determine a protection volume and an output based at least in part on the predicted future aircraft maneuvers.

As shown in FIG. 1, ASSAP tracker 104 interfaces with and uses TSAA system 106. TSAA system 106 may in some examples be implemented at least in part as a software package or software library comprising computer-executable instructions stored on and/or executed by TCAS computer 102, as well as data stored and/or processed at least in part by TCAS computer 102. TSAA system 106 may also be implemented in hardware or firmware in some examples. Air traffic data system 100 and TCAS computer 102 may also include various other systems and components beyond those shown in FIG. 1 and described below. TCAS computer 102 and/or TSAA system 106 may comprise one or more processors configured to implement the techniques of this disclosure.

A flight crew of an aircraft, which may include air traffic data system 100 in some examples, may fly the aircraft in accordance with established guidelines, which may be defined by an entity and followed by aircraft flying within certain regions. For example, the Radio Technical Commission for Aeronautics (RTCA) is an entity that defines Minimum Operational Performance Standards (MOPS or MPS) for General Aviation (GA) aircraft in the United States, including standard DO-317B, which corresponds in Europe to the ED-194 standard defined by European Organisation for Civil Aviation Equipment (Eurocae)). The DO-317B standard includes functionality specifications for Aircraft Surveillance Applications (ASA). In some examples, ASSAP tracker 104 using TSAA system 106 of FIG. 1 may fulfill the ASA functionality specifications of the DO-317B standard, and may also provide additional performance advantages that go beyond the Minimum Performance Standards defined by DO-317B. In other examples, ASSAP tracker 104 may fulfill other functionality specifications of other standards, such as the ED-194 standard or other standards for other regions.

ASSAP tracker 104 may determine, based at least in part on incoming target aircraft information 112, an estimated target aircraft state for each of one or more target aircraft within a selected range or vicinity, where the target aircraft state may include position, altitude, and velocity (both speed and vector of velocity). In some examples, ASSAP tracker 104 may determine and maintain a determined trajectory or track for each of the one or more target aircraft for as long as they remain active targets for tracking, e.g., they remain airborne and within a selected range or within a selected range of an airport proximate the aircraft (the "ownship") that includes air traffic data system 100 or with which system 100 is associated if system 100 is not located onboard an aircraft. ASSAP tracker 104 may also maintain extrapolated, predicted future trajectories or tracks for the ownship and all applicable target aircraft out to a selected common point in time in the future, and update those predicted tracks at a selected frequency, e.g., one hertz.

As noted above for air traffic data system 100 and TCAS computer 102, ASSAP tracker 104 and TSAA system 106 may be implemented on an aircraft or at a ground station. ASSAP tracker 104 may receive or collect, via transceiver 115 in air traffic data system 100 or another transceiver, target aircraft information 112 from one or more surrounding aircraft, which may be referred to as target aircraft, as inputs via an automatic dependent surveillance-broadcast (ADS-B) In Receiver and/or other surveillance data sources. Transceiver 115 is configured to receive information from one or more aircraft or other entities, and may include a network interface card (e.g., an Ethernet card), wireless Ethernet network radios (e.g., WiFi), cellular data radios, as well as universal serial bus (USB) controllers, optical transceivers, radio transceivers, or the like. Target aircraft information 112 may include air-to-air ADS-B reports, automatic dependent surveillance-rebroadcast (ADS-R), traffic information service—broadcast (TIS-B), active TCAS surveillance, and/or other sources of information on other aircraft. ASSAP tracker 104 may also receive ownship information 114 (information on the subject aircraft that hosts air traffic data system 100, if ASSAP tracker 104 is implemented on an aircraft as opposed to a ground station), as inputs. Ownship information 114 may originate from ADS-B reports or TCAS surveillance data that is available to air traffic data system 100. ASSAP tracker 104, or TSAA system 106, may use ownship information 114 to determine a location and a course of the ownship. ASSAP tracker 104 may also use data from other sources, such as a compass or sensors on the ownship, to determine the location and the course of the ownship.

The example of FIG. 1 is further discussed in context of an ASSAP tracker 104 and TSAA system 106 implemented on a subject aircraft that incorporates air traffic data system 100 (the ownship) and evaluating information for the ownship as well as one or more target aircraft. ASSAP tracker 104 may process those inputs, and output aircraft states 122, including target aircraft states and ownship aircraft states, specifying location or position, course or trajectory, and altitude information for the one or more target aircraft and the ownship, to TSAA system 106. An example of a flight context for aircraft maneuver prediction is discussed further below with reference to FIG. 2.

TSAA system 106 receives aircraft states 122 from ASSAP tracker 104 as inputs. TSAA system 106 includes a conflict detector unit 132 and a protocol data store 136. Conflict detector unit 132 includes aircraft maneuver prediction unit 134. Conflict detector unit 132 may interact with protocol data store 136 and use aircraft maneuver prediction unit 134, and potentially additional units or modules, to perform calculations based at least in part on aircraft states 122 and determine whether there is an imminent risk of two aircraft entering each other's protection volume or protected airspace (or coming too close to each other, as further described below). The protection volume may be defined relative to the respective aircraft and may define a volume of space around the aircraft. The protection volume may also be referred to as a protected airspace zone. When conflict detector component 132 makes a determination of an imminent risk of a protection volume violation, TSAA system 106 may generate, via output node 141, one or more alert outputs 142 of TSAA system 106 to ASSAP tracker 104. The alert outputs 142 generated by TSAA system 106 may indicate target aircraft alert states and alert levels for one or more specific target aircraft, in some examples.

ASSAP tracker 104 may then generate and output one or more alerts 144, e.g., to a pilot or flight crew of the ownship, based on the alert outputs 142 that ASSAP tracker 104 receives from TSAA system 106. ASSAP tracker 104 may output alerts 144 to audio and/or video output interfaces of air traffic data system 100, such as a display and a loudspeaker of the aircraft (e.g., a display in Class II systems and a loudspeaker in Class I or II systems), and/or other systems, components, or devices to which air traffic data system 100 may be operably connected. The alerts 144 generated by ASSAP tracker 104 may also include indications of target aircraft alert states and alert levels for one or more specific target aircraft, based on information in the alert outputs 142 from TSAA system 106, in some examples. Additional details of TSAA system 106 are further described below.

The baseline protection volume of a GA aircraft in flight proximate to an airport may be within five hundred feet (about one hundred and fifty-two meters) horizontal and two hundred feet (about sixty-one meters) vertical of the aircraft, in some examples. The baseline protection volume may differ for a GA aircraft in cruise or a GA aircraft taking off. The baseline protection volume may decrease when the aircraft is near an airport to prevent nuisance alerts. In some examples, the minimum horizontal radius may be seven hundred and fifty feet horizontally and four hundred and fifty feet vertically. ASSAP tracker 104 may recompute target aircraft and ownship states and output the recomputed or updated aircraft states 122 to TSAA system 106 at a rate of at or approximately one hertz or once per second, in some examples. ASSAP tracker 104 using TSAA system 106 may be specified to generate an alert when there is a risk of a protection volume violation (or intrusion) within twenty to thirty-five seconds of the predicted protection volume violation, for example, such that generating an initial alert less than twenty seconds prior to the predicted protection volume violation would be considered as a late alert or missed alert, in some examples.

TSAA system 106 may both track protection volumes around one or more target aircraft and the ownship, and perform trajectory predictions for the one or more target aircraft and the ownship. TSAA system 106 may implement alerting decision logic based on both the protection volumes and the predicted trajectories of each of one or more target aircraft and the ownship. TSAA system 106 may use the position, altitude, and velocity (both speed and vector of velocity) of each of one or more target aircraft and the ownship as inputs in making its determinations of whether to trigger an alert and potentially what information to include in an alert. Conflict detection unit 132 may propagate trajectories of the ownship and target aircraft to establish baseline protection volumes based on location, course, speed, and altitude of each aircraft. Conflict detection unit 132 may also establish horizontal and vertical protection volumes for each propagated node based on trajectory and closure rates between aircraft. TSAA system 106 may generate an alert based on determining that the propagated trajectory for the ownship is on course to enter the modified protection volume of a target aircraft.

In accordance with the techniques of this disclosure, aircraft maneuver prediction unit 134 may predict a future aircraft maneuver based at least in part on at least in part on the location and course of the aircraft determined by ASSAP tracker 104. In some examples, the location of an aircraft may include the latitude, longitude, and altitude. The location may also include the location relative to another point, such as an airport, airstrip, or a landing pad. The course of the aircraft may include the heading, track, and/or route of the aircraft, as well as the vertical and/or horizontal velocity of the aircraft. ASSAP tracker 104, or TSAA system 106 in some examples, may determine the location and the course of the aircraft based on surveillance data from ADS-B or TCAS.

Aircraft maneuver prediction unit 134 may also predict the future aircraft maneuver based at least in part on protocol data from protocol data store 136. Protocol data store 136 may store data relating to standard procedures such as federal aviation regulations and airfield traffic patterns for GA aircraft. Aircraft maneuver prediction unit 134 may correlate aircraft turns with airport traffic patterns based on the Radio Technical Commission for Aeronautics (RTCA) specification DO-317B algorithm to avoid wrap-around issues. The standard procedures may also include speeds and accelerations for landing and takeoff, as well as standard altitudes for cruising, flare maneuvers, and takeoff roll. Protocol data store 136 may make this data available to aircraft maneuver prediction unit 134. Aircraft maneuver prediction unit 134 may apply a filter involving velocity trending information to propagate trajectory and improve conflict detection. Example details of airplane maneuvers and trajectory propagation may be found in U.S. Patent Application entitled "AIRCRAFT MANEUVER DATA MANAGEMENT SYSTEM," filed Oct. 19, 2015, having application Ser. No. 14/886,982, which is incorporated herein by reference in its entirety.

Conflict detector unit 132 may use the predicted future aircraft maneuver to determine a protection volume that is modified relative to a baseline protection volume for the ownship or a target aircraft. The baseline protection volume may depend on the trajectory of the aircraft and whether the aircraft is taking off, cruising, or landing. The baseline protection volume may also depend on whether the aircraft is near an airport. The modified protection volume may be larger than the baseline protection volume in a vertical and/or horizontal direction. In some examples, the modified protection volume may expand in the direction of the predicted future aircraft maneuver.

ASSAP tracker 104 may generate an output, such as alert 144, based on the modified protection volume. Alert 144 may be based on the presence of a target aircraft in the modified protection volume determined by conflict detector unit 132. The output may also be a graphical user interface feature that displays the modified protection volume to a flight crew member, a ground crew member, an air traffic controller, or another user.

Figure 2:
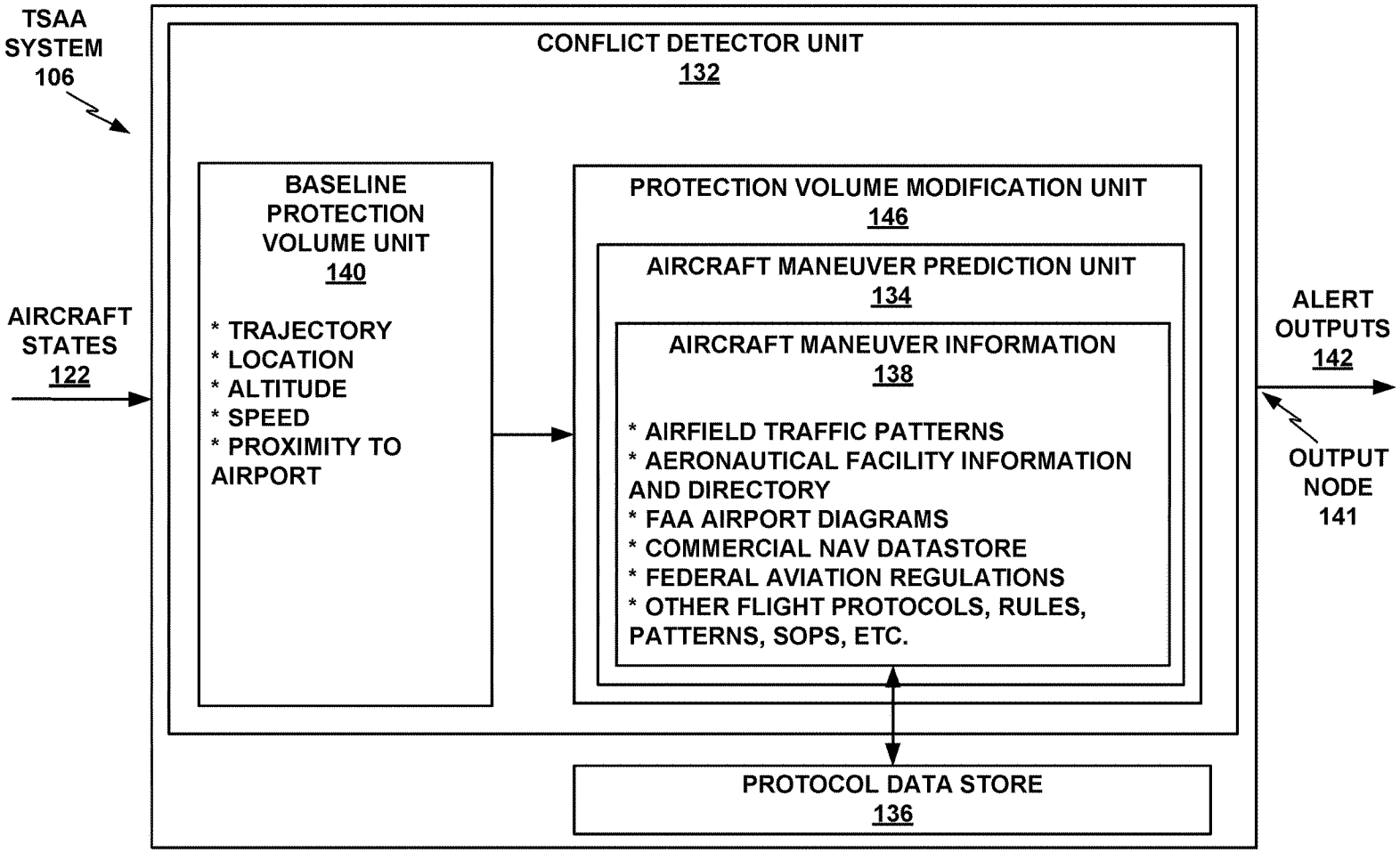
FIG. 2 depicts an example functional block diagram of an example TSAA system with additional detail in accordance with illustrative examples in which a conflict detector unit includes an aircraft maneuver prediction unit, as shown in FIG. 1.

FIG. 2 depicts an example functional block diagram of an example TSAA system 106 with additional detail in accordance with illustrative examples in which conflict detector unit 132 includes aircraft maneuver prediction unit 134, as shown in FIG. 1. Conflict detector unit 132 includes aircraft maneuver prediction unit 134 as part of protection volume modification unit 146, in this example. Conflict detector unit 132 also has access to protocol data store 136, and baseline protection volume unit 140, as shown in FIG. 2. Conflict detector unit 132 is configured to receive aircraft states 122 as inputs, determine and possibly modify a protection volume, determine whether there are any predictions of protection volume violations (as further described below), and generate alert outputs 142 based on those determinations, as described above with reference to FIG. 1.

Baseline protection volume unit 140 may receive the aircraft state input 122, which may include the trajectory, location, and speed of the ownship or a target aircraft. Baseline protection volume unit 140 may perform constant trajectory, constant turn rate, and varying turn rate methods, which may extrapolate current straight trajectories, current constant turn rates, and current varying turn rates of a subject aircraft, respectively to predict the trajectory of the aircraft. Baseline protection volume unit 140 may determine a baseline protection volume based on the trajectory, location, altitude, and speed of the aircraft, as well as the presence of any nearby airports. Baseline protection volume unit 140 may create a baseline protection volume for the ownship or a target aircraft by applying the aircraft state data to one or more algorithms in stored in TSAA system 106. The algorithms may result in a larger baseline protection volume for higher speeds and remoteness from an airport and a smaller baseline protection volume for lower speeds and proximity to an airport. Baseline protection volume unit 140 may output a baseline protection volume to protection volume modification unit 146.

Protection volume modification unit 146 may modify the baseline protection volume based at least in part on a predicted aircraft maneuver, as determined by aircraft maneuver prediction unit 134, which may include aircraft maneuver information 138. Aircraft maneuver information 138, in algorithmic and/or data store implementation, may incorporate any of the following examples of procedural or flight protocol information sources (as partially shown in FIG. 2): standard traffic pattern operations as may be encoded or described in any of various references; the Airport/Facility Directory (A/FD) as published by the U.S. Department of Transportation or another entity; U.S. Federal Aviation Administration (FAA) Airport Diagrams or airport diagrams from another entity; commercial navigation databases and/or data stores, which may include airport configuration information and airport runway configuration information, and/or one or more subsets of or interfaces with such commercial navigation databases and/or data stores; an autonomous airport configuration recognition system implemented by onboard systems; and/or other protocols, rules, airfield traffic patterns, airport-applicable standard operating procedures (SOPs), standard piloting practices, flight operation reference information, or other patterns or conventions of general aviation piloting, for example, all of which may be collectively referred to as "protocol data" for purposes of this disclosure (e.g., aircraft maneuver information 138 of FIG. 2).

Aircraft maneuver prediction unit 134 may also apply, e.g., algorithmic means of simplifying criteria and/or logic applicable to aircraft maneuver prediction based on data or information from any aircraft maneuver information sources, including those listed above. Similarly, for purposes of this disclosure, "aircraft maneuver prediction" may collectively refer to trajectory prediction (e.g., by aircraft maneuver prediction unit 134) based at least in part on aircraft maneuver information (e.g., aircraft maneuver information 138) as opposed to simple constant straight trajectory, constant turn rate, and/or constantly varying track angle (e.g., which may be computed or implemented by other elements of baseline protection volume unit 140). "Standard procedures" may refer to the maneuvers incorporated in protocol data, such as the turns, changes in altitude, accelerations, and threshold velocities that an aircraft may likely perform in order to operate safely or comply with regulations.

Aircraft maneuver prediction unit 134 may incorporate aircraft maneuver information 138 directly in algorithms of its executable instructions, in some examples. Aircraft maneuver prediction unit 134 may also incorporate or interface with aircraft maneuver information 138 in the form of an aircraft maneuver information data store that may store either all or some (e.g., an auxiliary set) of the aircraft maneuver information, in some examples. In some examples in which an aircraft maneuver information data store is used, the aircraft maneuver information data store may be implemented as an in-memory data cache to avoid buffering latency for real-time operating performance, e.g., to implement assured execution times in a selected fraction of a second, to support one-hertz update rates for aircraft trajectories and airspace violation determinations. Aircraft maneuver prediction unit 134 may incorporate aircraft maneuver information 138 as either or both of direct algorithmic incorporation of aircraft maneuver information and/or accessing an aircraft maneuver information data store, in various examples. In some examples, incorporating aircraft maneuver information 138 directly in algorithms of its executable instructions may allow faster processing speed for aircraft maneuver prediction unit 134, while in some examples, implementing the aircraft maneuver information 138 in a data store (e.g., an in-memory data cache system such as Redis, Memcached, etc.) may enable more flexibility and ease of adding to or modifying the aircraft maneuver information. In various examples, aircraft maneuver prediction unit 134 may comply with the RTCA DO-178B standard, Software Considerations in Airborne Systems and Equipment Certification.

While performing aircraft maneuver prediction using aircraft maneuver information, TSAA system 106 of this disclosure may predict a wide variety of future changes in the trajectory or trajectories of one or more aircraft based on realistic assessments of future changes in trajectories based on the aircraft maneuver information. The aircraft maneuver information may enable TSAA system 106 to propagate (or predict) a flight path of a target aircraft more accurately compared to examples in which the flight path of a target aircraft is predicted without consideration of the procedural behavior of aircraft. TSAA system 106 of this disclosure performing aircraft maneuver prediction using aircraft maneuver information may achieve a substantially higher accuracy in generating protected airspace violation alerts, relative to other air traffic alert systems. The improved accuracy of alerts of TSAA system 106 of this disclosure may include both a higher percentage of alerts generated when proper, as well as a reduced percentage of false positives, or nuisance alerts, that may be frequently generated by some air traffic alert systems.

For example, when an air traffic alert system determines a protection volume, the system may base the protection volume on the current trajectory and one or more current aircraft maneuvers. The current trajectory and current aircraft maneuvers may not indicate future aircraft maneuvers, which may involve the aircraft changing course or changing altitude outside of the baseline protection volume. As a result, a baseline protection volume may not account for the future movement of the aircraft. In contrast, TSAA system 106 of this disclosure may modify the baseline protection volume to account for future aircraft maneuvers, e.g., by predicting the future aircraft maneuvers based at least in part on the location and course of the aircraft, as well as data relating to standard procedures. Thus, TSAA system 106 may increase the accuracy of alerts of possible collisions before the aircraft begins a predicted future aircraft maneuver, relative to other TSAA algorithms. For example, TSAA system 106 may modify the baseline protection volume for an aircraft on a runway when the aircraft reaches a threshold velocity that is associated with takeoff. In such an example, a modified baseline protection volume may be larger than the baseline protection volume in the upward vertical direction when the predicted future aircraft maneuver is a takeoff. If conflict detector unit 132 in TSAA system 106 determines that an aircraft or obstacle may infringe the modified protection volume, conflict detector unit 132 may generate an alert output 142 via output node 141.

Figure 3:
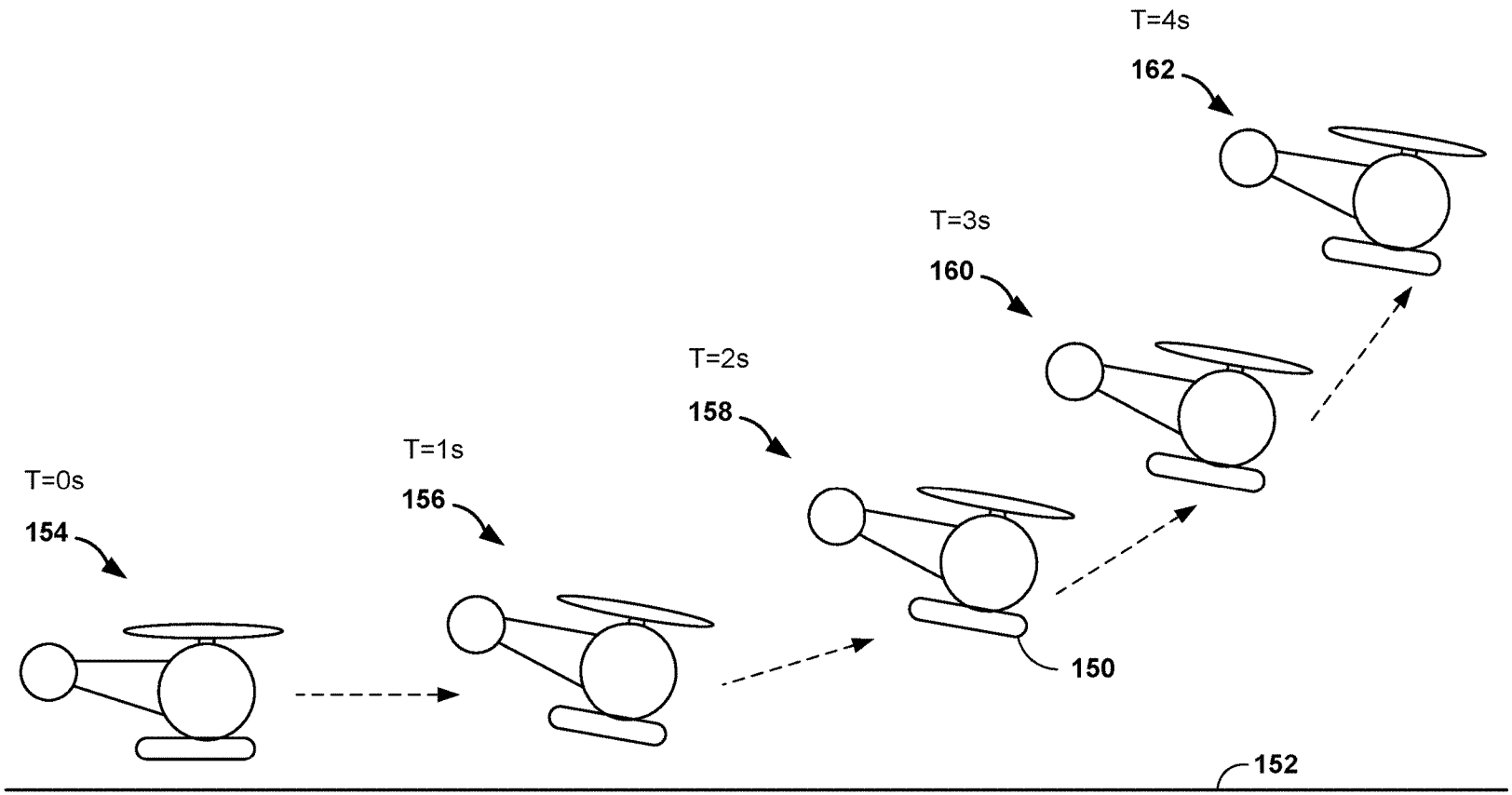
FIG. 3 depicts an example takeoff maneuver for an aircraft, in accordance with some examples of this disclosure.

FIG. 3 depicts an example takeoff maneuver for an aircraft 150, in accordance with some examples of this disclosure. FIG. 3 depicts aircraft 150 as a helicopter, but aircraft 150 may be any suitable type of aircraft that executes a takeoff maneuver similar to the maneuver shown in FIG. 3. Surface 152 may be a landing pad, a helipad, a runway, an airstrip, roadway, or any other surface for takeoff. Helicopter Flying Handbook, FAA-H-8083-21A, chapter nine, includes further details on basic flight maneuvers.

Time 154 may correspond to zero seconds. The example takeoff maneuver in FIG. 3 is depicted as having a duration of four seconds. In some examples, the example takeoff maneuver may have a longer or shorter duration. The window size for trajectory propagation may be set to thirty-five seconds according to MOPS. At time 154, aircraft 150 may be elevated above surface 152 with zero horizontal velocity and nearly zero vertical velocity. At time 154, aircraft 150 may be hovering above surface 152.

At time 156, the horizontal velocity of aircraft 150 may increase rapidly. The vertical velocity of aircraft 150 may be near zero or slightly positive. For purposes of this disclosure, a positive vertical velocity may indicate that the altitude of aircraft 150 is increasing. At time 158, the horizontal velocity of aircraft 150 may remain similar to the horizontal velocity at time 156. The vertical velocity and altitude of aircraft 150 at time 158 may increase at time 158, as compared to times 154, 156.

At time 160, the horizontal velocity of aircraft 150 may remain similar to the horizontal velocity at times 156, 158. In some examples, the horizontal velocity of aircraft 150 may increase or decrease at time 160 but still remain positive. The vertical velocity of aircraft 150 at time 160 may remain similar or increase further such that the altitude at time 160 is higher than the altitude at times 156, 158.

At time 162, the horizontal velocity of aircraft 150 may remain similar to the horizontal velocity at times 158, 160. In some examples, the horizontal velocity of aircraft 150 may increase or decrease at time 162 but still remain positive. The vertical velocity of aircraft 150 at time 162 may remain similar or increase further so that the altitude at time 162 is higher than the altitude at times 158, 160.

In the context of this disclosure, FIG. 3 may depict a takeoff maneuver as a standard procedure. At time 154, TSAA system 106 may predict that the horizontal velocity of aircraft 150 may increase, even though the horizontal velocity at time 154 may be at or near zero. TSAA system 106 of this disclosure may determine the vertical velocity of aircraft 150 at or just before time 154 and determine that the vertical velocity exceeds a threshold vertical velocity. TSAA system 106 may determine that aircraft 150 has not started the predicted future aircraft maneuver by determining that the horizontal velocity at time 154 is at or near zero. TSAA system 106 may consequently determine a modified protection volume with a larger horizontal dimension relative to the baseline protection volume to account for the predicted future increase in horizontal velocity that may be associated with takeoff of aircraft 150. TSAA system 106 thus determines a modified protection volume for the aircraft that is modified relative to the baseline protection volume by increasing a horizontal dimension of the protection volume relative to the baseline protection volume, based at least in part on the predicted future aircraft maneuver of an increase in horizontal velocity.

Figure 4:
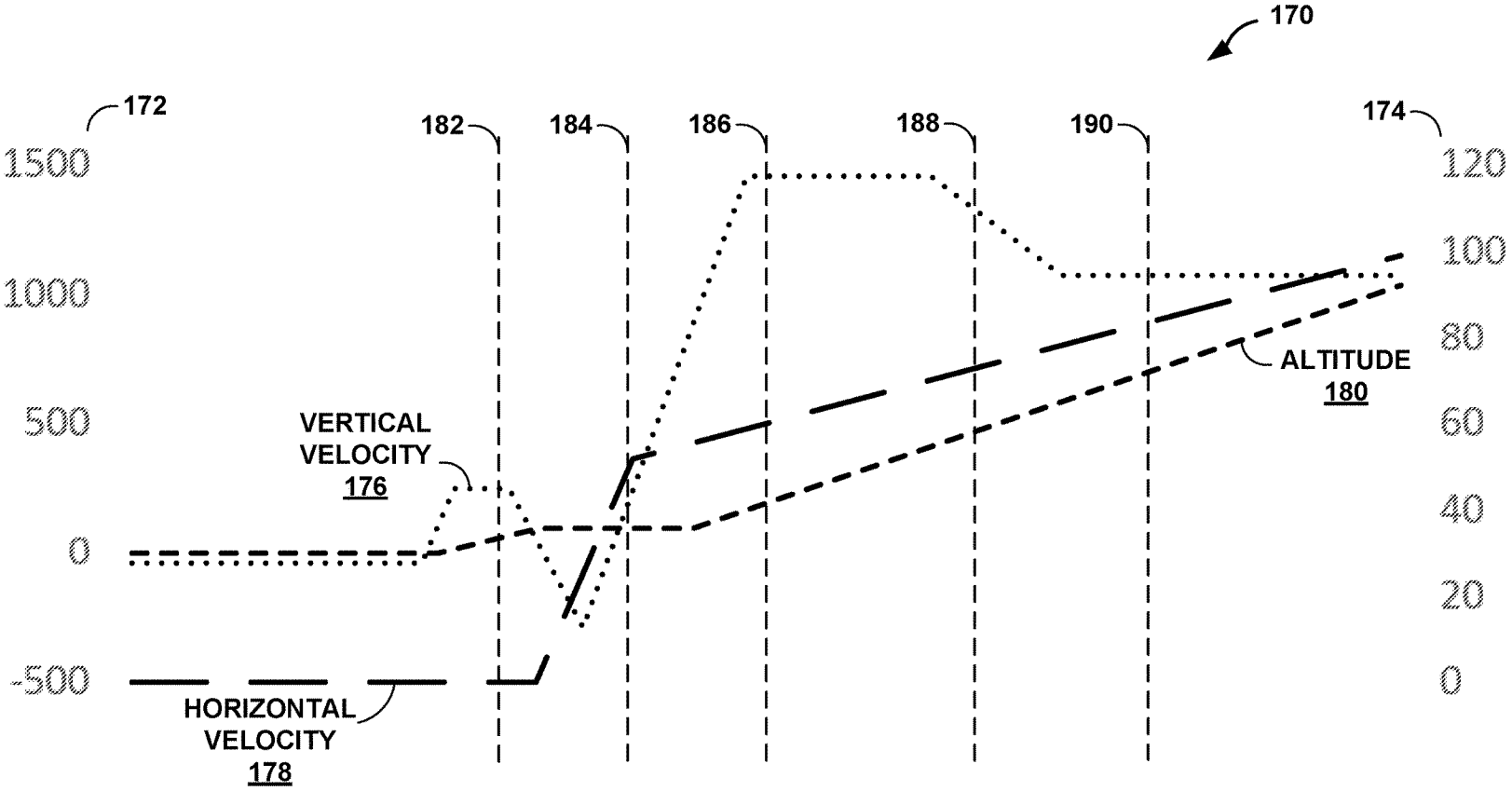
FIG. 4 depicts a graph of vertical velocity, horizontal velocity, and altitude for an aircraft during takeoff, in accordance with some examples of this disclosure.

FIG. 4 depicts a graph 170 of vertical velocity 176, horizontal velocity 178, and altitude 180 for an aircraft during takeoff, in accordance with some examples of this disclosure. Vertical velocity 176, horizontal velocity 178, and altitude 180 in graph 170 may be approximations that correspond to positions and velocities of aircraft 150 at times 154-162 in FIG. 3. For example, times 182, 184, 186, 188, 190 may correspond to times 154, 156, 158, 160, 162 in FIG. 3.

The horizontal axis of graph 170 may correspond to time. Vertical axis 172 may correspond to values for vertical velocity 176 and altitude 180. Vertical axis 174 may correspond to values for horizontal velocity 178. At time 182, the aircraft may be hovering, meaning that vertical velocity 176 and horizontal velocity 178 are near zero. At time 184, the aircraft may maintain a near-zero altitude 180, but horizontal velocity may increase rapidly. At times 186, 188, 190, horizontal velocity 178 and altitude 180 may increase as the aircraft takes off.

TSAA system 106 may predict a future aircraft maneuver at time 182. The predicted future aircraft maneuver may be an increase in horizontal velocity. TSAA system 106 may base the prediction on determining that vertical velocity 176 at time 182 exceeds a threshold vertical velocity and that the aircraft has not started the predicted future aircraft maneuver. TSAA system 106 may modify a baseline protection volume by increasing a horizontal dimension of the baseline protection volume.

TSAA system 106 may also predict a future aircraft maneuver at time 184. The predicted future aircraft maneuver may be an increase in vertical velocity. TSAA system 106 may base the prediction on determining that horizontal velocity 178 at time 182 exceeds a threshold horizontal velocity and that the aircraft has not started the predicted future aircraft maneuver. TSAA system 106 may modify a baseline protection volume by increasing a vertical dimension of the protection volume, thereby determining a modified protection volume for the aircraft. TSAA system 106 thus determines a modified protection volume for the aircraft that is modified relative to the baseline protection volume by increasing a vertical dimension of the protection volume relative to the baseline protection volume, based at least in part on the predicted future aircraft maneuver of an increase in vertical velocity.

Figure 5:
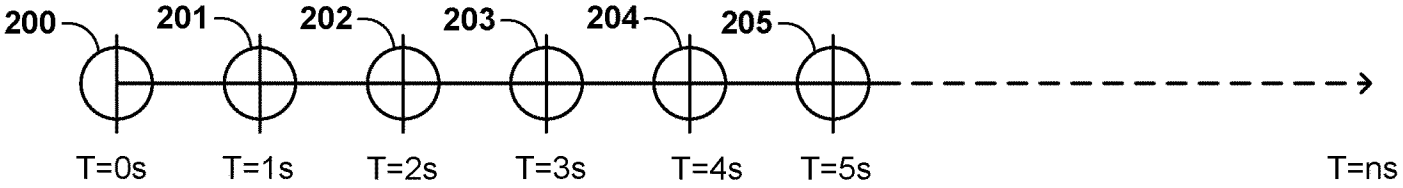
FIG. 5 depicts trajectory propagation for an aircraft using constant velocity, in accordance with some examples of this disclosure.

FIG. 5 depicts trajectory propagation for an aircraft using constant velocity, in accordance with some examples of this disclosure. TSAA system 106 or ASSAP tracker 104 may determine the location and course of the aircraft. TSAA system 106 may determine a future position of the aircraft based at least in part on the current velocity, assuming no turns and no acceleration. FIG. 5 may depict the protection volume as a circle at times 200-205, but the protection volume may be another shape or may vary in some examples.

Figure 6:
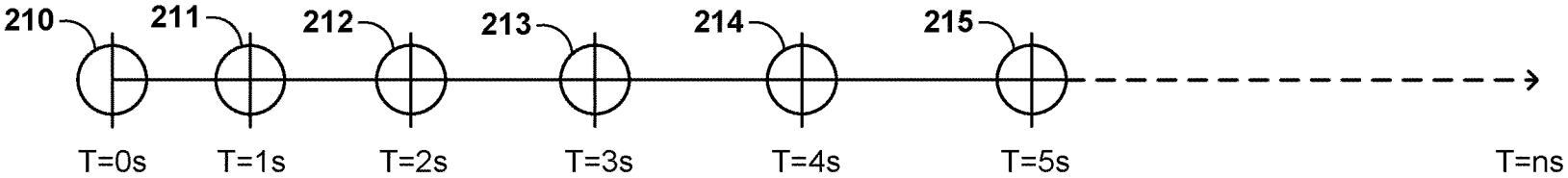
FIG. 6 depicts trajectory propagation for an aircraft using an intention-based predictive algorithm, in accordance with some examples of this disclosure.

FIG. 6 depicts trajectory propagation for an aircraft using an intention-based predictive algorithm, in accordance with some examples of this disclosure. TSAA system 106 or ASSAP tracker 104 may determine the location and course of the aircraft. TSAA system 106 may determine a future position based at least in part on the current velocity and a set of protocol data indicating one or more standard procedures for one or more aircraft maneuvers. In the example of FIG. 6, the aircraft maneuver may be takeoff, and the standard procedure may be to accelerate at a constant rate. As a result, trajectory propagation may predict that the velocity of the aircraft will continue to increase during times 210-215.

Figure 7:
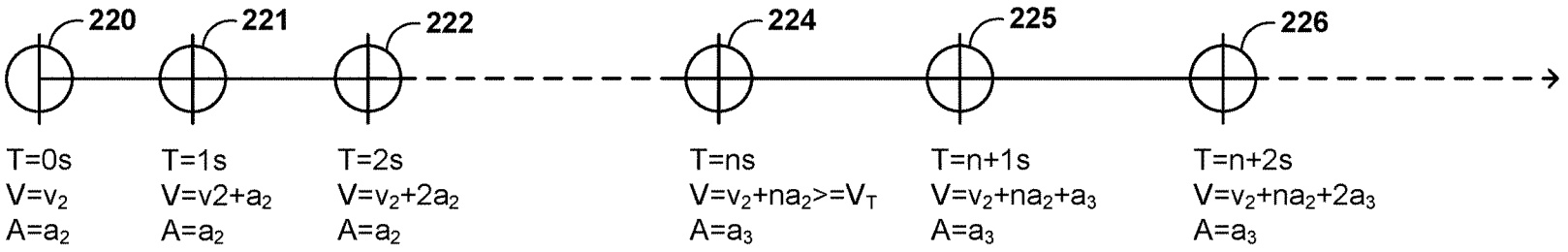
FIG. 7 depicts trajectory propagation for an aircraft using a threshold velocity to reduce acceleration, in accordance with some examples of this disclosure.

FIG. 7 depicts trajectory propagation for an aircraft using a threshold velocity to reduce acceleration, in accordance with some examples of this disclosure. During times 220-222, the aircraft may accelerate at a constant rate $a_2$. At time 224, TSAA system 106 may determine that the velocity exceeds a threshold velocity $V_T$. At time 224, TSAA system 106 may reduce the predicted acceleration from $a_2$ to $a_3$, which may be less than half of $a_2$. A set of protocol data indicating standard procedures for aircraft maneuvers may include the numerical value of the threshold velocity. In some examples, the aircraft maneuver may be takeoff, and the standard procedure may be acceleration to a threshold horizontal velocity before reducing acceleration at times 224-226.

The acceleration may reduce to zero as the aircraft reaches cruise velocity of approximately one hundred and forty knots in the example of a helicopter. For some examples involving helicopters, TSAA system 106 may refrain from increasing the vertical dimension of the protection volume because takeoff, hovering taxi, and air taxi may exhibit similar maneuvers. In order to prevent nuisance alerts, TSAA system 106 may refrain from enlarging the protection volume in certain circumstances.

Figure 8:
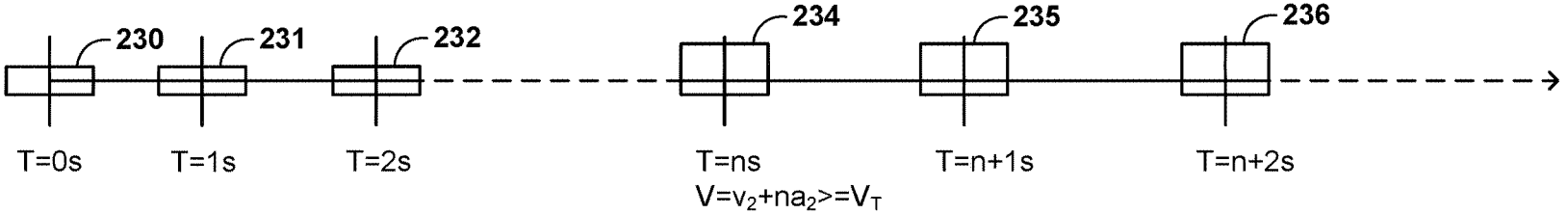
FIG. 8 depicts a two-dimensional side view of a modified protection volume based at least in part on a predicted future aircraft maneuver, in accordance with some examples of this disclosure.

FIG. 8 depicts a two-dimensional side view of a modified protection volume based at least in part on a predicted future aircraft maneuver, in accordance with some examples of this disclosure. Trajectory propagation in FIG. 8 may be similar to trajectory propagation in FIG. 7 such that the acceleration decreases when the velocity exceeds a threshold velocity.

TSAA system 106 may determine a baseline protection volume when the horizontal velocity of an aircraft is less than the threshold horizontal velocity, such as at times 230-232. If TSAA system 106 determines that the velocity exceeds the threshold velocity, such as at times 234-236, TSAA system 106 may determine a modified protection volume. TSAA system 106 may also base a predicted future aircraft maneuver on a propagated trajectory of the aircraft, which TSAA system 106 may base at least in part on the acceleration of the aircraft. TSAA system 106 may propagate a trajectory for the aircraft based on current and expected future acceleration of the aircraft, as well as the location and the course of the aircraft. The modified protection volume may be larger than the baseline protection volume in the vertical dimension. TSAA system 106 may predict that the aircraft will increase altitude during takeoff after reaching a threshold horizontal velocity. TSAA system 106 may access protocol data for a standard procedure such as takeoff, and the standard procedure may include the aircraft increasing altitude after the horizontal velocity exceeds a threshold horizontal velocity.

In some examples, a fixed wing aircraft may employ an acceleration process on a runway during takeoff. The vertical velocity may be at or near zero until the aircraft reaches a threshold horizontal velocity. The aircraft is unlikely to lift off the runway when the horizontal velocity is less than the threshold. However, a takeoff from a soft field may include a lower threshold horizontal velocity followed by lower vertical velocity just after liftoff until the aircraft reaches a threshold vertical velocity or threshold angle. The threshold horizontal velocity for a helicopter may be sixteen to twenty-four knots to reach effective translational lift. The threshold horizontal velocity may be higher, such as thirty to sixty knots, based on a variety of factors.

Figure 9:
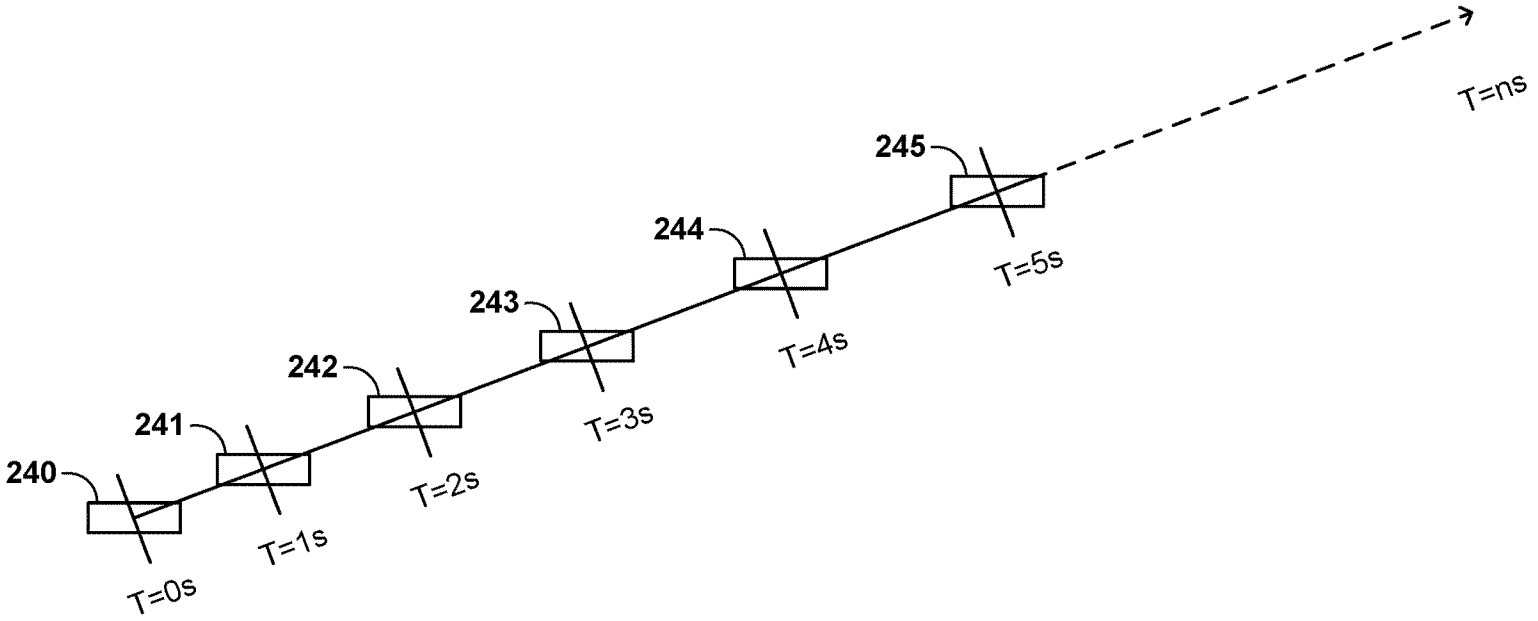
FIG. 9 depicts a two-dimensional side view of a baseline protection volume after a predicted future aircraft maneuver has started, in accordance with some examples of this disclosure.

FIG. 9 depicts a two-dimensional side view of a baseline protection volume after a predicted future aircraft maneuver has started, in accordance with some examples of this disclosure. The aircraft maneuver may be an increase in altitude as the aircraft takes off a runway, an airstrip, or the like.

TSAA system 106 may determine a course and location of the aircraft at time 240. TSAA system 106 may determine that the aircraft has positive vertical velocity, i.e., increasing altitude. At time 240, TSAA system 106 may determine that the aircraft has started a predicted aircraft maneuver (i.e., positive vertical velocity and increasing altitude). Based at least in part on the determination that the aircraft has started a predicted aircraft maneuver, TSAA system 106 may switch from generating an output based on the modified protection volume (see FIG. 8) to generating an output based on a baseline protection volume and generate an output based on the baseline protection volume, such as an alert or a display for flight crew or ground crew. The output may also include data for transmission to an aircraft or a recipient on the ground. TSAA system 106 may continue to generate outputs based on the baseline protection volume at times 241-245. The baseline protection volume may adequately protect the aircraft if the course and acceleration of the aircraft remain constant at times 241-245.

Figure 10:
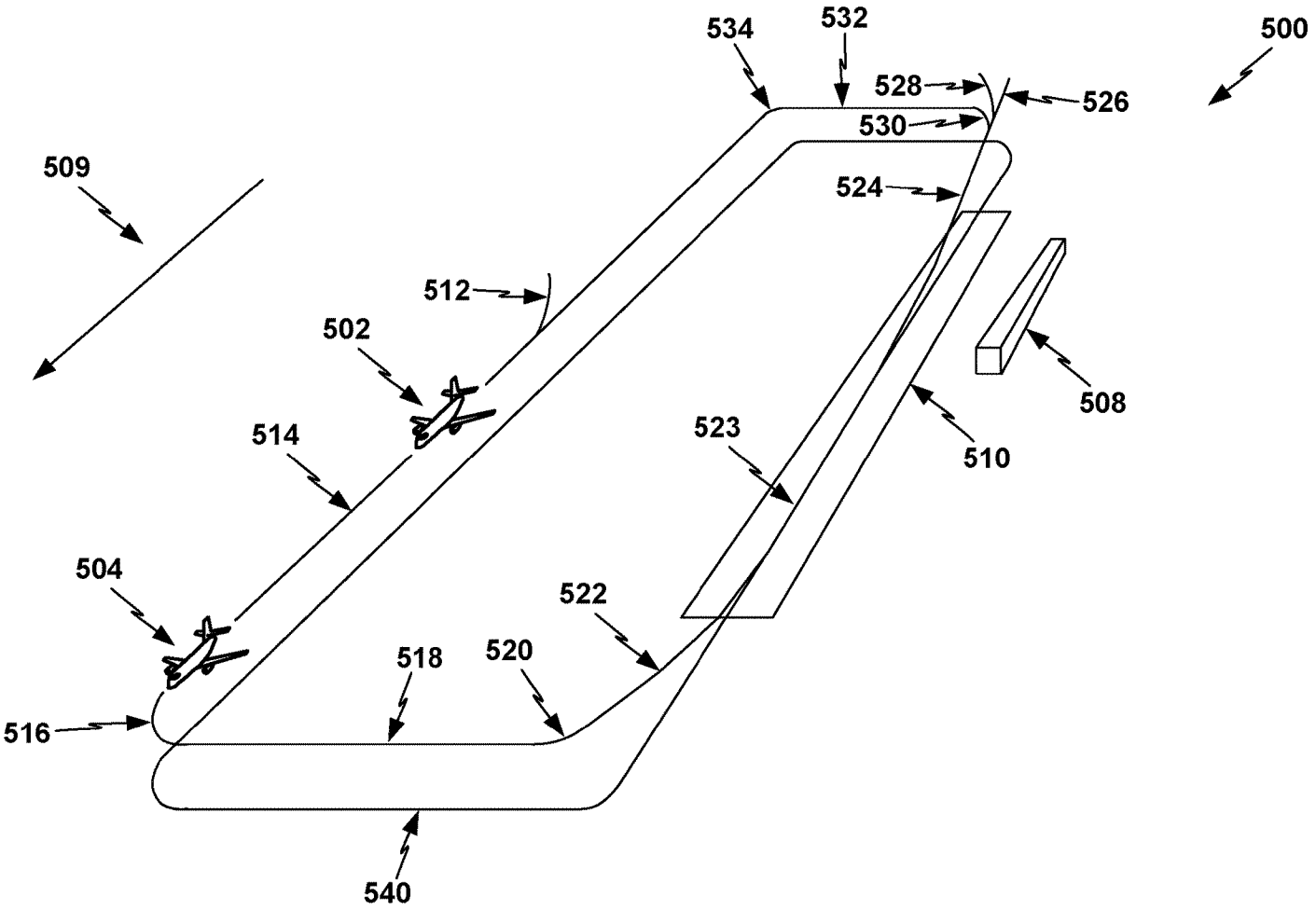
FIG. 10 shows a conceptual perspective diagram of an airfield traffic pattern for a runway, in accordance with some examples of this disclosure.

FIG. 10 shows a conceptual perspective diagram of an airfield traffic pattern for a runway 510, in accordance with some examples of this disclosure. Airplane Flying Handbook, FAA-H-8083-3A, chapter seven, includes details on airport traffic patterns. FIG. 10 shows airport airspace 500 around a general aviation (GA) airport with ownship 502 and target aircraft 504, in flight in accordance with a standard procedural flight pattern as may be predicted by TSAA system 106. Wind direction 509 may be parallel to runway 510 with downwind to the left relative to an observer at airport terminal 508, indicating a left-turn air traffic configuration according to procedural air traffic standards (to ensure takeoff into the wind). In cases where the wind direction is opposite to wind direction 509 of this example, procedural flight standards may indicate similar flight patterns but in opposite directions, in a right-turn air traffic configuration. Ownship 502 may enter the procedural pattern at entry turn 512, placing ownship 502 in downwind track 514 behind target aircraft 504. Standard flight procedure may indicate for target aircraft 504 and ownship 502 to follow downwind track 514, base turn 516 into base track 518, and final approach turn 520 to final approach 522 and landing 523, along with steadily reducing speed along this path. In some examples, if an aircraft is not aligned with the centerline of runway 510 during an approach, the aircraft may level out at a traffic pattern altitude for the class associated with the aircraft.

Standard flight procedure for aircraft taking off from runway 510 may include accelerating along track 523 to lift off into departure track 524. Depending on its intended heading, an aircraft in takeoff may continue ascending along a straight line path 526, a shallow turn 528, or a crosswind turn 530 into crosswind track 532, and a subsequent left turn 534 if continuing on a heading opposite to the direction of takeoff. FIG. 10 also shows path 540 as the ground track below and corresponding to the procedural flight tracks 512-534. Aircraft in flight in airspace 500 may be guided by an air traffic control (ATC) tower, or in airports without an ATC tower, the aircraft may fly in accordance with visual acquisition and observation of other aircraft traffic and adherence to standard flight rules and other procedures, such as pursuing the flight tracks 512-534 as described above and maintaining minimum separations from any surrounding target aircraft.

In some circumstances, aircraft 502 and 504 may follow tracks 514, 516, 518, 520, 522, and 523 in order and separated by a standard procedural separation distance along tracks 514-523 throughout the process; while in other circumstances, some deviations from both aircrafts' adherence to this sequence of tracks may occur. In one example without any deviations, aircraft 502 and 504 may begin from the positions as shown in FIG. 10 at a minimum standard procedural separation from each other, when target aircraft 504 begins executing base leg turn 516. Target aircraft 504 may be flying at a lower speed than ownship 502 since it is further along in the process of decelerating for its landing.

As aircraft 502 and 504 approach base leg turn 516, TSAA system 106 may predict base leg turn 516 as a future aircraft maneuver for aircraft 502 and/or 504. TSAA system 106 may base the prediction of base leg turn 516 on the location and course of aircraft 502 and 504 relative to runway 510. TSAA system 106 may also base the prediction of base leg turn 516 on a set of protocol data indicating standard procedures, such as an airfield traffic pattern, for one or more aircraft maneuvers, such as landing. The protocol data may include the dimensions of runway 510 and the dimensions of path 540. TSAA system 106 may determine a modified protection volume based at least in part on the predicted aircraft maneuver (i.e., base leg turn 516) and generate an output based on the modified protection volume. In some examples, the modified protection volume may be larger than a baseline protection volume in a horizontal dimension to account for the predicted base leg turn 516.

Figure 11:
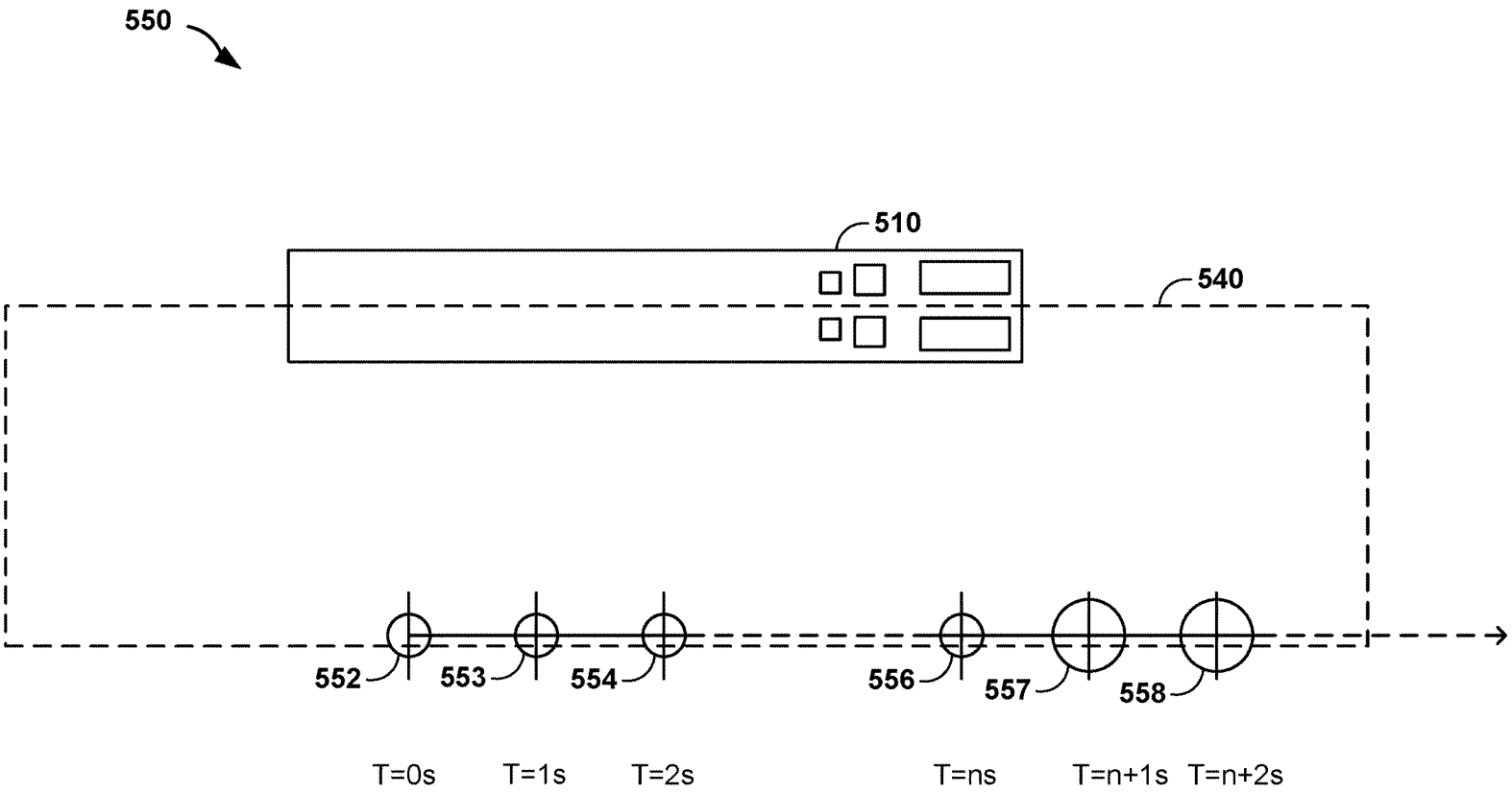
FIG. 11 shows a two-dimensional top view of a modified protection volume based at least in part on a predicted aircraft maneuver near an airfield traffic pattern, in accordance with some examples of this disclosure.

FIG. 11 shows a two-dimensional top view of a modified protection volume based at least in part on a predicted aircraft maneuver near airfield traffic pattern 550, in accordance with some examples of this disclosure. Airfield traffic pattern 550 may include path 540 over runway 510. Path 540 may be rectangular and may extend past the ends of runway 510 so that aircraft can takeoff from and land at runway 510.

At times 552-554, TSAA system 106 may determine the location and course of an aircraft relative to runway 510. TSAA system 106 may also determine a current aircraft maneuver, which may comprise a lack of turns at times 552-558. TSAA system 106 may refrain from predicting a horizontal turn at times 552-554 or at time 556 because the aircraft is abeam runway 510, or has not passed the end of runway 510. FIG. 11 may depict the baseline protection volume at times 552-554 as a circular top view of a cylindrical volume in space, but the baseline protection volume may be any suitable shape for protecting an aircraft.

At times 557, 558, TSAA system 106 may predict a left horizontal turn as a future aircraft maneuver, possibly near a forty-five-degree line projected from the end of the runway, where the angle is measured from the centerline of the runway. TSAA system 106 may predict the future aircraft maneuver based at least in part on the course and the location of the aircraft relative to runway 510. In particular, the aircraft at times 557, 558 has passed an end of runway 510 but has not changed course or started the predicted future aircraft maneuver. The modified protection volume at times 557, 558 may be a cylindrical volume that is larger than the baseline protection volume, or the modified protection volume may be larger than the baseline protection volume only in the direction of the predicted future aircraft maneuver.

For an aircraft at times 552-554, TSAA system 106 may extend the horizontal protection volume to beyond the end of the runway, e.g., the location at time 557. If TSAA system 106 detects deceleration at times 552-554, TSAA system 106 may predict that the aircraft is preparing to landing after completing the base turns on path 540. However, if the base turn does not occur, TSAA system 106 may switch back to generating an output based on the baseline protection volume upon determining that the aircraft has exited the airfield traffic pattern.

Figure 12:
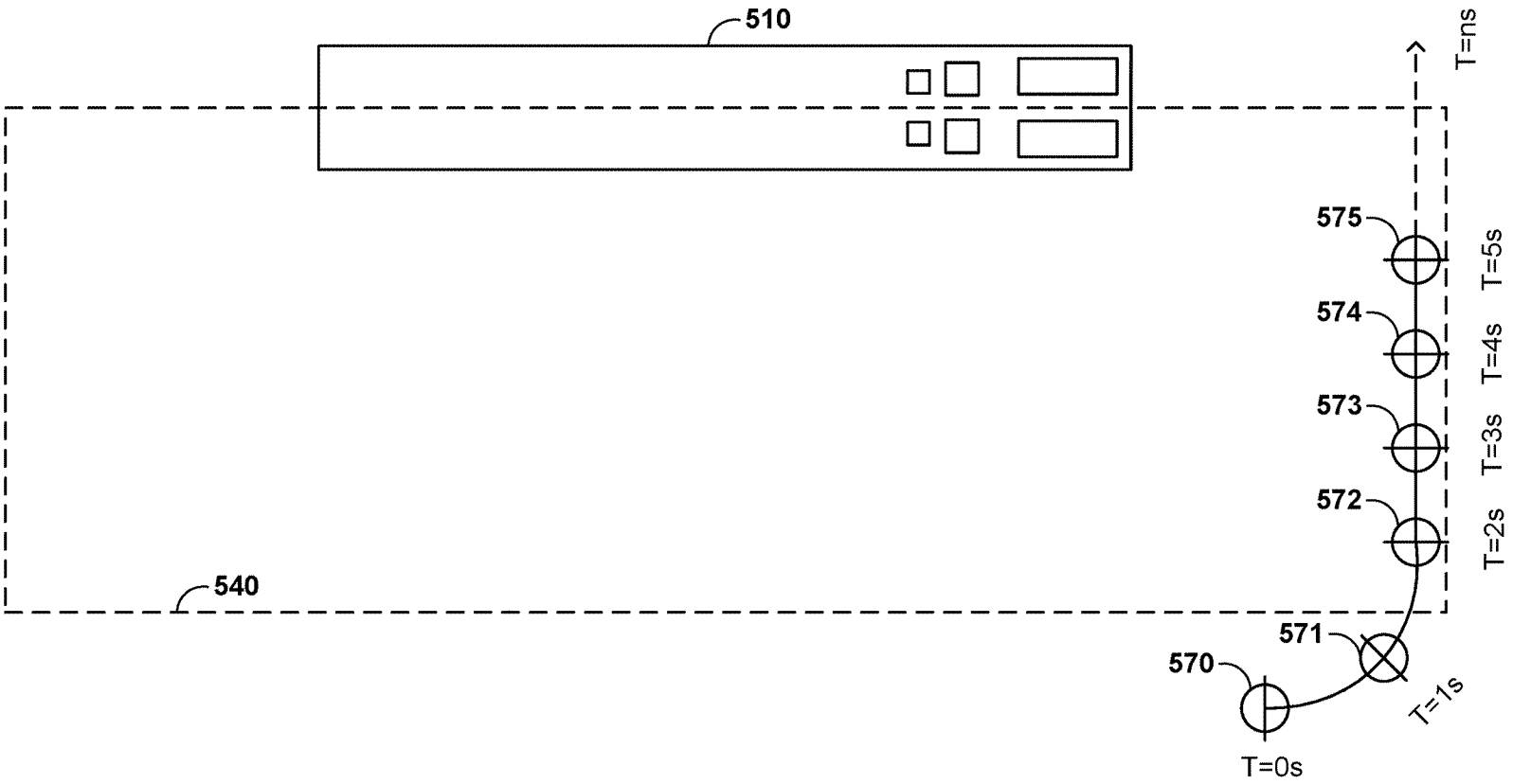
FIG. 12 shows a two-dimensional side view of a baseline protection volume near an airfield traffic pattern, in accordance with some examples of this disclosure.

FIG. 12 shows a two-dimensional top view of a baseline protection volume near an airfield traffic pattern, in accordance with some examples of this disclosure. Path 540 may be a rectangular airfield traffic pattern stored in a set of protocol data with one or more aircraft maneuvers, such as horizontal turns. At times 570-575, TSAA system 106 may refrain from predicting a future aircraft maneuver, such as a horizontal turn, based at least in part on determining that the aircraft has already started a horizontal turn. Instead, TSAA system 106 may switch from generating an output based on the modified protection volume to generating an output based on a baseline protection volume for times 570-575.

Figure 13:
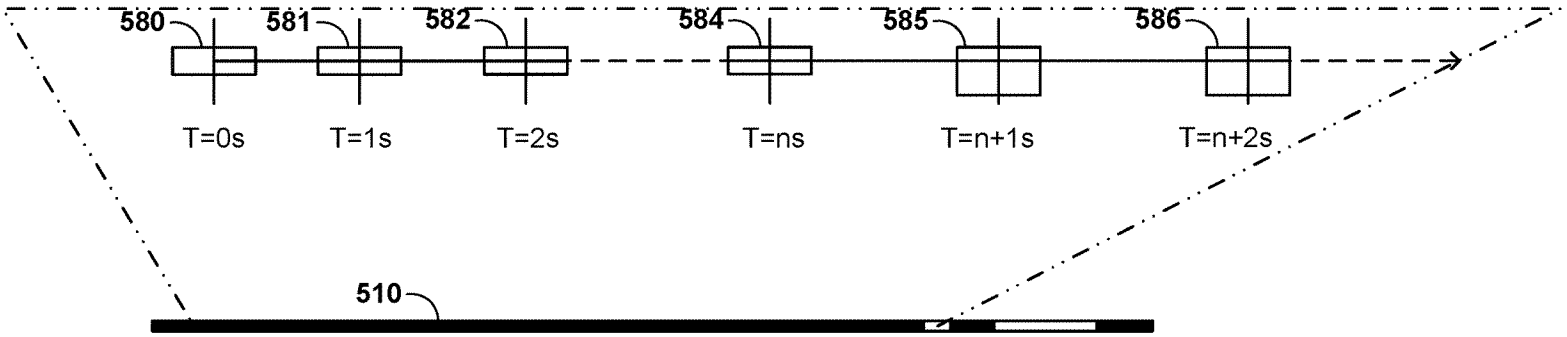
FIG. 13 shows a two-dimensional side view of a modified protection volume based at least in part on a predicted aircraft maneuver near an airfield traffic pattern, in accordance with some examples of this disclosure.

FIG. 13 shows a two-dimensional side view of a modified protection volume based at least in part on a predicted aircraft maneuver near an airfield traffic pattern, in accordance with some examples of this disclosure. At times 580-586, TSAA system 106 may determine the location and course of an aircraft relative to runway 510. TSAA system 106 may refrain from predicting a horizontal turn at times 580-582 or at time 584 because the aircraft is abeam runway 510, or has not passed the end of runway 510. FIG. 13 may depict the baseline protection volume at times 580-582, 584 as a two-dimensional side view of a cylindrical volume, but the baseline protection volume may be any suitable shape for protecting an aircraft.

At times 585, 586, TSAA system 106 may predict a negative vertical velocity (i.e., reduction in altitude) as a future aircraft maneuver. TSAA system 106 may predict the future aircraft maneuver based at least in part on the course and the location of the aircraft relative to runway 510. TSAA system 106 may also predict the future aircraft maneuver based at least in part on a current aircraft maneuver, which may comprise zero vertical velocity at times 585, 586. In particular, the aircraft at times 585, 586 has passed an end of runway 510 but has not changed course or started the predicted future aircraft maneuver. The modified protection volume at times 585, 586 may be a cylindrical volume that is larger than the baseline protection volume only in the direction of the predicted future aircraft maneuver, which in the example of FIG. 13 may be the downward direction. TSAA system 106 may increase the protection volume by, e.g., a few hundred feet in the downward direction in this example, though lesser or greater spatial extensions may be applied in other examples.

Figure 14:
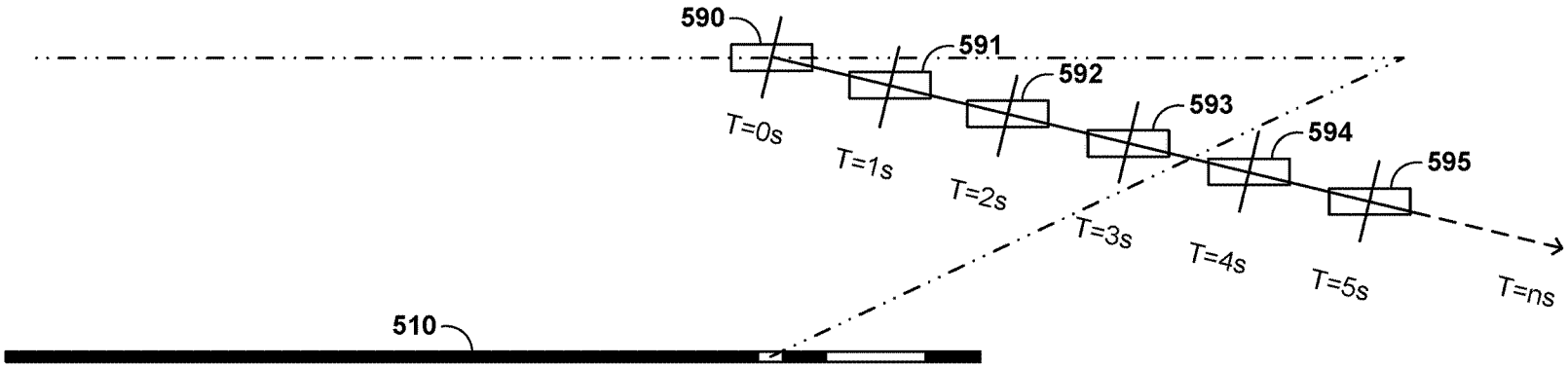
FIG. 14 shows a baseline protection volume near an airfield traffic pattern, in accordance with some examples of this disclosure.

FIG. 14 shows a two-dimensional side view of a baseline protection volume near an airfield traffic pattern, in accordance with some examples of this disclosure. At times 590-595, TSAA system 106 may refrain from predicting a future aircraft maneuver, such as a negative vertical velocity, based on determining that the aircraft has already started a horizontal turn. Instead, TSAA system 106 may switch from generating an output based on the modified protection volume (see FIG. 13) to generating an output based on a baseline protection volume for times 590-595.

In some examples, during a landing maneuver, a helicopter may reduce horizontal velocity to almost zero before touching down. A fixed wing aircraft may touch down at a higher horizontal velocity, as compared to a helicopter. TSAA system 106 may therefore use the aircraft characteristics and surveillance data to predict a landing maneuver.

Figure 15:
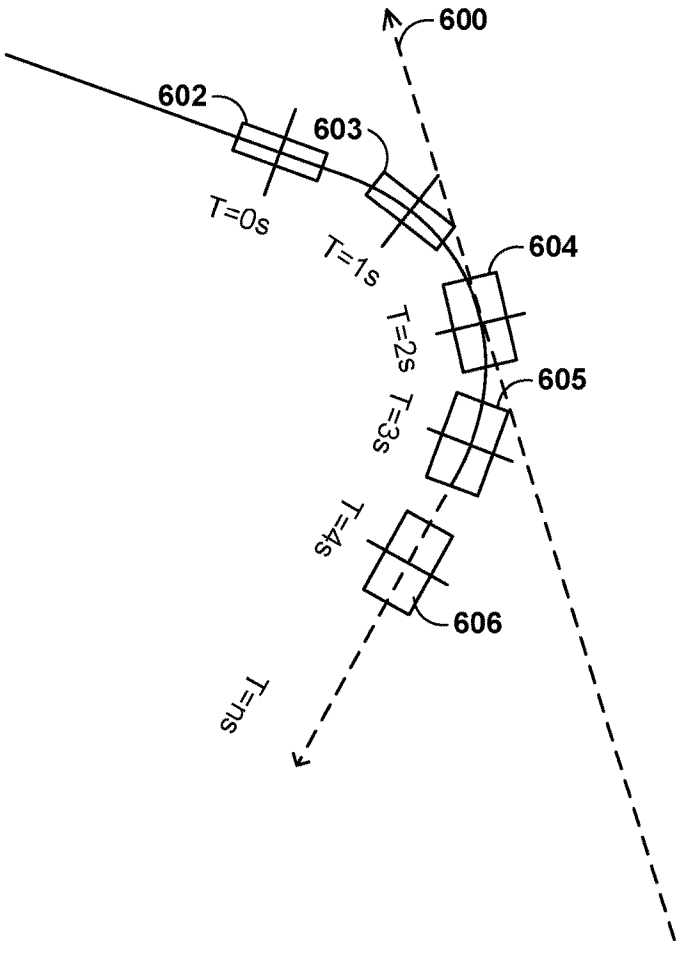
FIG. 15 shows a two-dimensional top view of a modified protection volume based at least in part on a predicted aircraft maneuver with respect to magnetic north, in accordance with some examples of this disclosure.

FIG. 15 shows a two-dimensional top view of a modified protection volume based at least in part on a predicted aircraft maneuver with respect to magnetic north 600, in accordance with some examples of this disclosure. Magnetic north 600 may vary from geographical north in some examples. Many standard procedures are based on a course of an aircraft with respect to magnetic north 600, such as federal aviation regulations, part 91, sections 159 and 179. For example, when the aircraft is cruising under visual flight rules (VFR) at more than three thousand feet above ground level and less than eighteen thousand feet above mean sea level, protocol data may indicate that the aircraft have an altitude at an odd number of thousand feet plus five hundred feet when travelling east relative to magnetic north 600. When the aircraft is travelling west relative to magnetic north 600, protocol data may indicate that the aircraft have an altitude at an even number of thousand feet plus five hundred feet. Therefore, when an aircraft turns and changes course relative to magnetic north 600, TSAA system 106 may predict a change in altitude by one thousand feet.

At times 602, 603, TSAA system 106 may determine the course of an aircraft relative to magnetic north 600. TSAA system 106 may refrain from predicting a horizontal turn at times 602, 603 because the course of the aircraft is east relative to magnetic north 600. FIG. 15 may depict the baseline protection volume at times 602, 603 as a rectangular cross-section of a cylindrical volume, but the baseline protection volume may be any suitable shape for protecting an aircraft.

At times 604-606, TSAA system 106 may predict a change in altitude as a future aircraft maneuver. TSAA system 106 may predict the future aircraft maneuver based at least in part on the course of the aircraft relative to magnetic north 600. In particular, the aircraft at times 604-606 may have a course that is west relative to magnetic north 600, but the aircraft may not have changed altitude to comply with VFR, i.e., the aircraft has not started the predicted future aircraft maneuver. The modified protection volume at times 604-606 may be a rectangular cross-section of a cylindrical volume that is larger than the baseline protection volume only in the direction of the predicted future aircraft maneuver, which in the example of FIG. 15 may be the upward and/or downward directions. Although FIG. 15 is a two-dimensional top view, FIG. 15 depicts widened protection volumes at times 604-606. However, the protection volumes at times 604-606 may be enlarged in the vertical dimension, i.e., into or out of the page. In some examples, the protection volumes in FIGS. 15-16 may be a cylindrical volume with the length of the cylinder extending in the vertical direction, as shown in FIGS. 8-9 and 11-14.

Figure 16:
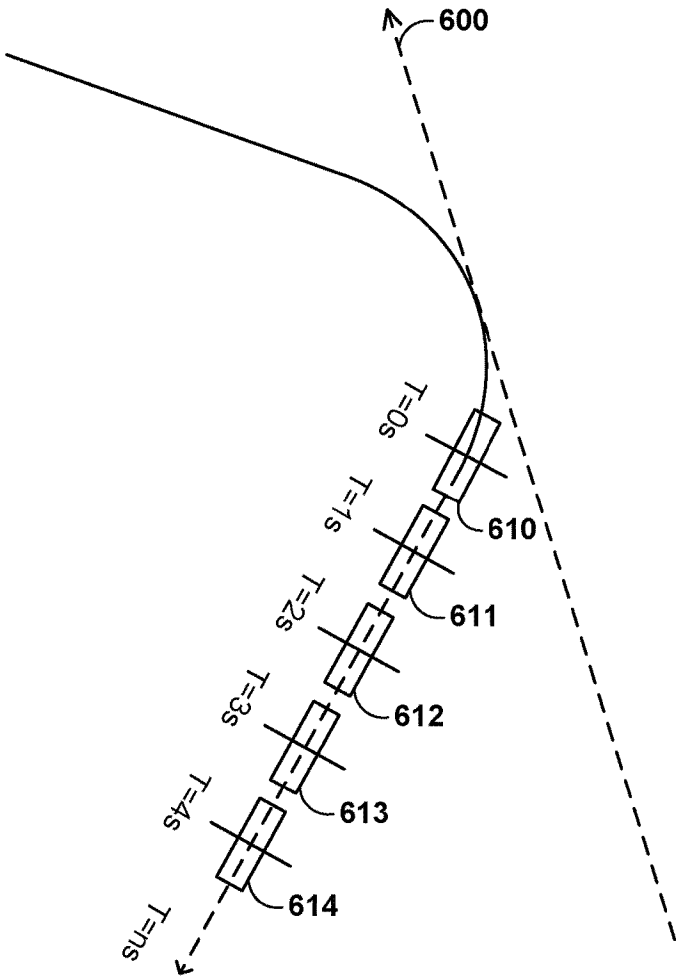
FIG. 16 shows a two-dimensional top view of a baseline protection volume after completing a turn maneuver, in accordance with some examples of this disclosure.

FIG. 16 shows a two-dimensional top view of a baseline protection volume after completing a turn maneuver, in accordance with some examples of this disclosure. At times 610-615, TSAA system 106 may refrain from predicting a future aircraft maneuver, such as a change in altitude, based at least in part on determining that the aircraft has already started to change altitude after having changed course relative to magnetic north 600. Instead, TSAA system 106 may switch from generating an output based on the modified protection volume (see FIG. 15) to generating an output based on a baseline protection volume for times 610-615.

Figure 17:
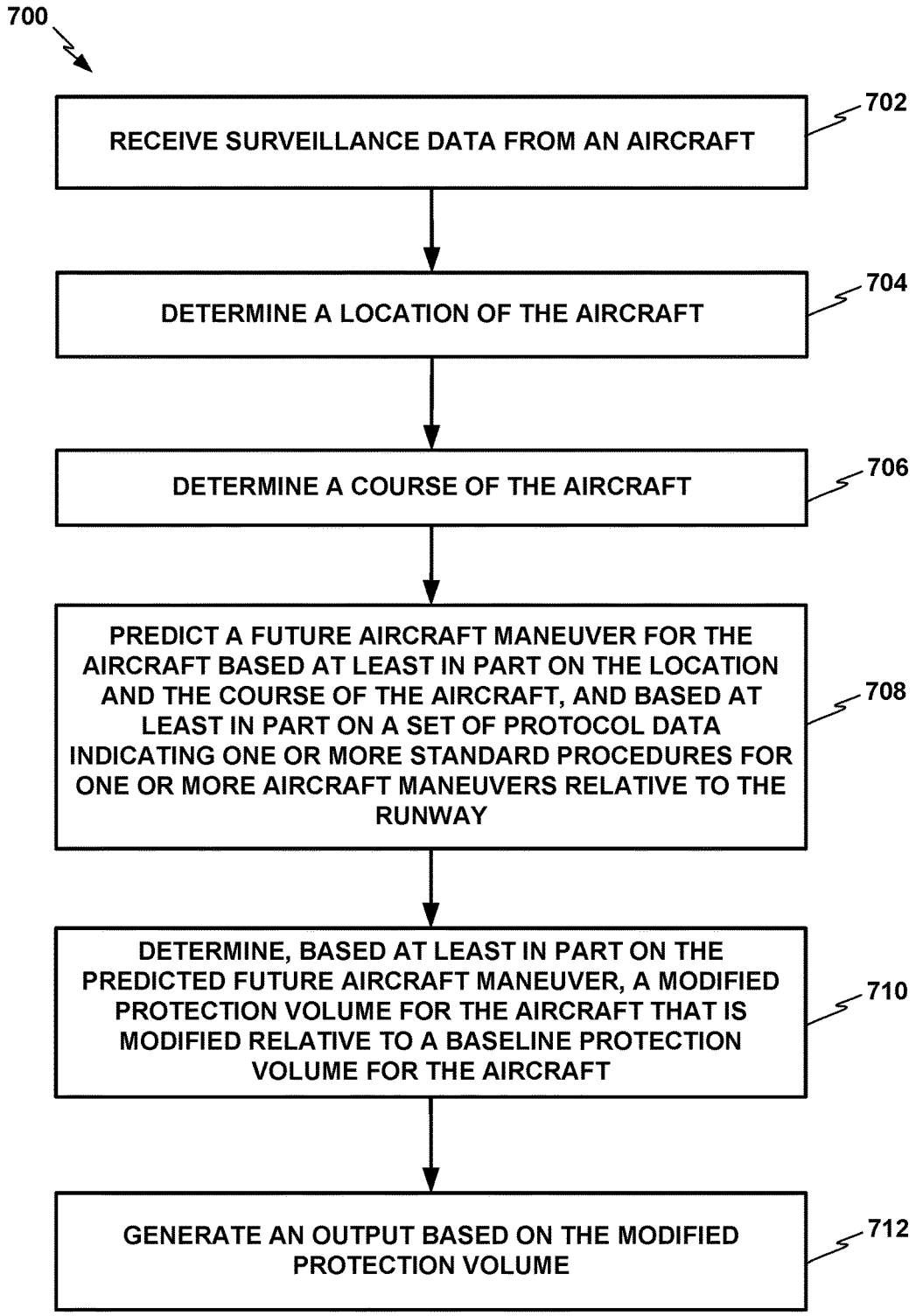
FIG. 17 shows a flowchart for an example technique for determining a modified protection volume, in accordance with some examples of this disclosure.

FIG. 17 shows a flowchart for an example technique 700 for determining a modified protection volume, in accordance with some examples of this disclosure. Technique 700 is described with reference to the system of FIG. 1, including ASSAP tracker 104 and TSAA system 106, although other components, such as aircraft maneuver prediction unit 134 in FIG. 1 or 2, may perform similar techniques.

The technique of FIG. 17 includes receiving surveillance data from an aircraft (702). AS SAP tracker 104 may receive surveillance data from ownship 114 and target aircraft 112. The received surveillance data may originate in ADS-B reports or broadcasts and other data from external sources, as well as data from sensors and compasses.

The technique of FIG. 17 further includes determining a location of the aircraft based at least in part on the received surveillance data (704). ASSAP tracker 104 may determine the location, which may include latitude, longitude, and altitude. AS SAP tracker 104 may determine the location of the aircraft relative to a runway or another fixed landmark.

The technique of FIG. 17 further includes determining a course of the aircraft based at least in part on the received surveillance data (706). ASSAP tracker 104 may determine the course, which may include direction, heading, route, and trajectory. ASSAP tracker 104 may determine the course of the aircraft relative to a runway, another fixed landmark, geographical north, or magnetic north.

The technique of FIG. 17 further includes predicting a future aircraft maneuver for the aircraft based at least in part on the location and the course of the aircraft, and based at least in part on a set of protocol data indicating one or more standard procedures for one or more aircraft maneuvers (708). For example, TSAA system 106 may predict a turn or change in altitude based at least in part on the data received from ASSAP tracker 104. TSAA system 106 may predict a turn based at least in part on determining that the aircraft has passed the end of a nearby runway and has not started turning yet.

The technique of FIG. 17 further includes determining, based at least in part on the predicted future aircraft maneuver, a modified protection volume for the aircraft that is modified relative to a baseline protection volume for the aircraft (710). TSAA system 106 may enlarge the baseline protection volume in the direction of the predicted aircraft maneuver. For example, TSAA system 106 may enlarge the protection volume in the vertical dimension after the aircraft changes direction relative to magnetic north and before the aircraft begins the predicted aircraft maneuver.

The technique of FIG. 17 further includes generating an output based at least in part on the modified protection volume (712). The output may be an alert or display to flight crew, ground crew, air traffic control, or another person. The output may be transmission of data to an external recipient, such as another aircraft or a recipient on the ground, such as air traffic control.

The following examples may illustrate one or more of the techniques of this disclosure.

Example 1

A system is configured to receive surveillance data from an aircraft, determine a location of the aircraft based at least in part on the received surveillance data, and determine a course of the aircraft based at least in part on the received surveillance data. The system is further configured to predict a future aircraft maneuver for the aircraft based at least in part on the location and the course of the aircraft, and based at least in part on a set of protocol data indicating one or more standard procedures for one or more aircraft maneuvers. The system is further configured to determine, based at least in part on the predicted future aircraft maneuver, a modified protection volume for the aircraft that is modified relative to a baseline protection volume for the aircraft. The system is further configured to generate an output based on the modified protection volume.

Example 2

The system of example 1, further configured to determine a second course of the aircraft at a second time and determine a second location of the aircraft at the second time. The system is further configured to determine, based at least in part on the second course of the aircraft and the second location of the aircraft, that the aircraft has started the predicted future aircraft maneuver. The system is further configured to switch from generating an output based on the modified protection volume to generating an output based on the baseline protection volume based at least in part on determining that the aircraft has started the predicted future aircraft maneuver, and generate a second output based on the baseline protection volume.

Example 3

The system of example 1 or 2, further configured to determine the course of the aircraft by at least determining a course of the aircraft relative to a runway based at least in part on the received surveillance data. The system is further configured to determine the location of the aircraft by at least determining a location of the aircraft relative to the runway based at least in part on the received surveillance data.

Example 4

The system of any one of examples 1 to 3, wherein the one or more standard procedures comprises an airfield traffic pattern, and the predicted future aircraft maneuver comprises a turn. The system is further configured to determine that the aircraft has passed an end of the runway, determine that the aircraft has not started the predicted future aircraft maneuver, and determine the modified protection volume with a larger horizontal dimension than the baseline protection volume based at least in part on determining that the aircraft has passed the end of the runway and has not started the predicted future aircraft maneuver.

Example 5

The system of any one of examples 1 to 4, wherein the one or more standard procedures comprises an airfield traffic pattern, and the predicted future aircraft maneuver comprises a decrease in altitude. The system is further configured to determine that the aircraft has passed an end of the runway, determine that the aircraft has not started the predicted future aircraft maneuver, and determine the modified protection volume with a larger vertical dimension than the baseline protection volume based at least in part on determining that the aircraft has passed the end of the runway and has not started the predicted future aircraft maneuver.

Example 6

The system of any one of examples 1 to 5, wherein the one or more standard procedures comprises a takeoff, and the predicted future aircraft maneuver comprises an increase in altitude. The system is further configured to determine a horizontal velocity of the aircraft, determine that the horizontal velocity of the aircraft exceeds a threshold horizontal velocity, determine that the aircraft has not started the predicted future aircraft maneuver, and determine the modified protection volume with a larger vertical dimension than the baseline protection volume based at least in part on determining that the horizontal velocity of the aircraft exceeds the threshold horizontal velocity.

Example 7

The system of any one of examples 1 to 6, wherein the aircraft comprises a helicopter; the one or more standard procedures comprises a takeoff, and the predicted future aircraft maneuver comprises an increase in horizontal velocity. The system is further configured to determine a vertical velocity of the aircraft, determine that the vertical velocity of the aircraft exceeds a threshold vertical velocity, determine that the aircraft has not started the predicted future aircraft maneuver, and determine the modified protection volume with a larger horizontal dimension than the baseline protection volume based at least in part on determining that the horizontal velocity of the aircraft exceeds the threshold vertical velocity.

Example 8

The system of any one of examples 1 to 7, wherein the one or more standard procedures comprises a turn during cruise, and the predicted future aircraft maneuver comprises a change in altitude. The system is further configured to determine that the course of the aircraft has changed relative to a magnetic north and determine the modified protection volume with a larger vertical dimension than the baseline protection volume based at least in part on determining that the course of the aircraft has changed relative to the magnetic north.

Example 9

The system of any one of examples 1 to 8, wherein the output comprises an alert in response to a second aircraft being detected inside the modified protection volume.

Example 10

A method includes receiving surveillance data from an aircraft, determining a location of the aircraft based at least in part on the received surveillance data, and determining a course of the aircraft based at least in part on the received surveillance data. The method further includes predicting a future aircraft maneuver for the aircraft based at least in part on the location and the course of the aircraft, and based at least in part on a set of protocol data indicating one or more standard procedures for one or more aircraft maneuvers. The method further includes determining, based at least in part on the predicted future aircraft maneuver, a modified protection volume for the aircraft that is modified relative to a baseline protection volume for the aircraft and generating an output based on the modified protection volume.

Example 11

The method of example 10, further comprising determining a second course of the aircraft at a second time, determining a second location of the aircraft at the second time. The method further comprises determining, based at least in part on the second course of the aircraft and the second location of the aircraft, that the aircraft has started the predicted future aircraft maneuver. The method further comprises switching from generating an output based on the modified protection volume to generating an output based on the baseline protection volume based at least in part on determining that the aircraft has started the predicted future aircraft maneuver, and generating a second output based on the baseline protection volume.

Example 12

The method of example 10 or 11, further comprising determining the course of the aircraft by at least determining a course of the aircraft relative to a runway based at least in part on the received surveillance data and determining the location of the aircraft by at least determining a location of the aircraft relative to the runway based at least in part on the received surveillance data.

Example 13

The method of any one of examples 10 to 12, wherein the one or more standard procedures comprises an airfield traffic pattern, the predicted future aircraft maneuver comprises a turn. The method further includes determining that the aircraft has passed an end of the runway, determining that the aircraft has not started the predicted future aircraft maneuver, and determining the modified protection volume with a larger horizontal dimension than the baseline protection volume based at least in part on determining that the aircraft has passed the end of the runway and has not started the predicted future aircraft maneuver.

Example 14

The method of any one of examples 10 to 13, wherein the one or more standard procedures comprises an airfield traffic pattern, the predicted future aircraft maneuver comprises a decrease in altitude. The method further includes determining that the aircraft has passed an end of the runway, determining that the aircraft has not started the predicted future aircraft maneuver, and determining the modified protection volume with a larger vertical dimension than the baseline protection volume based at least in part on determining that the aircraft has passed the end of the runway and has not started the predicted future aircraft maneuver.

Example 15

The method of any one of examples 10 to 14, wherein the one or more standard procedures comprises a takeoff, and the predicted future aircraft maneuver comprises an increase in altitude. The method further includes determining a horizontal velocity of the aircraft; determining that the horizontal velocity of the aircraft exceeds a threshold horizontal velocity, determining that the aircraft has not started the predicted future aircraft maneuver, and determining the modified protection volume with a larger vertical dimension than the baseline protection volume based at least in part on determining that the horizontal velocity of the aircraft exceeds the threshold horizontal velocity.

Example 16

The method of any one of examples 10 to 15, wherein the aircraft comprises a helicopter, the one or more standard procedures comprises a takeoff, and the predicted future aircraft maneuver comprises an increase in horizontal velocity. The method further includes determining a vertical velocity of the aircraft, determining that the vertical velocity of the aircraft exceeds a threshold vertical velocity. The method further includes determining that the aircraft has not started the predicted future aircraft maneuver, and determining the modified protection volume with a larger horizontal dimension than the baseline protection volume based at least in part on determining that the horizontal velocity of the aircraft exceeds the threshold vertical velocity.

Example 17

The method of any one of examples 10 to 16, wherein the one or more standard procedures comprises a turn during cruise, and the predicted future aircraft maneuver comprises a change in altitude. The method further includes determining that the course of the aircraft has changed relative to a magnetic north and determining the modified protection volume with a larger vertical dimension than the baseline protection volume based at least in part on determining that the course of the aircraft has changed relative to the magnetic north.

Example 18

The method of any one of examples 10 to 17, wherein the output comprises an alert in response to a second aircraft being detected inside the modified protection volume.

Example 19

A system comprises means for receiving surveillance data from an aircraft. The system further comprises means for determining a location of the aircraft based at least in part on the received surveillance data and means for determining a course of the aircraft based at least in part on the received surveillance data. The system further comprises means for predicting a future aircraft maneuver for the aircraft based at least in part on the location and the course of the aircraft, and based at least in part on a set of protocol data indicating one or more standard procedures for one or more aircraft maneuvers. The system further comprises means for determining, based at least in part on the predicted future aircraft maneuver, a modified protection volume for the aircraft that is modified relative to a baseline protection volume for the aircraft and means for generating an output based on the modified protection volume.

Example 20

The device of claim 19, wherein the system further comprises means for performing one of the methods of examples 11-18.

TCAS computer 102 and/or its components or features, including AS SAP tracker 104, TSAA system 106, aircraft maneuver prediction unit 134, and/or other components or features thereof, may include one or more processors. The one or more processors may comprise any suitable arrangement of hardware, software, firmware, or any combination thereof, to perform the techniques attributed to TCAS computer 102 and/or any of its components or features described herein. For example, the one or more processors may include any one or more microprocessors, digital signal processors (DSPs), application specific integrated circuits (ASICs), field programmable gate arrays (FPGAs), or any other equivalent integrated or discrete logic circuitry, as well as any combinations of such components. TCAS computer 102 and/or its components or features (e.g., aircraft maneuver information 138) may also include a memory which can include any volatile or non-volatile media, such as a RAM, ROM, non-volatile RAM (NVRAM), electrically erasable programmable ROM (EEPROM), flash memory, and the like. The memory may store computer readable instructions that, when executed by the one or more processors of TCAS computer 102 and/or its components or features cause the processors to implement functions and techniques attributed herein to TCAS computer 102 and/or its components or features.

Elements of TCAS computer 102 and/or its components or features as disclosed above may be implemented in any of a variety of additional types of solid state circuit elements, such as central processing units (CPUs), application-specific integrated circuits (ASICs), a magnetic nonvolatile random-access memory (RAM) or other types of memory, a mixed-signal integrated circuit, a field programmable gate array (FPGA), a microcontroller, a programmable logic controller (PLC), a system on a chip (SoC), a subsection of any of the above, an interconnected or distributed combination of any of the above, or any other type of component or one or more components capable of being configured in accordance with any of the examples disclosed herein. Elements of TCAS computer 102 and/or its components or features may be programmed with various forms of software. Elements of TCAS computer 102 and/or its components or features as in any of the examples herein may be implemented as a device, a system, an apparatus, and may embody or implement a method of combining air traffic surveillance data, including for implementing example technique 700 as described with reference to FIG. 17.

An "aircraft" as described and claimed herein may be or include any fixed-wing or rotary-wing aircraft, airship (e.g., dirigible or blimp buoyed by helium or other lighter-than-air gas), suborbital spaceplane or reusable launch vehicle stage, spacecraft, or other type of flying device, and may be crewed or uncrewed (e.g., unmanned aerial vehicle (UAV) or flying robot). While some description uses the example of ADS-B radio surveillance data, other examples may use extensions or modifications to ADS-B, or other forms of ADS-B-like radio surveillance, or ADS-C or any kind of radio surveillance data, in any manner described in terms of the example of ADS-B data in the description herein.

Any of the systems of the examples of FIGS. 1-16 as described above, or any component thereof, may be implemented as a device, a system, an apparatus, and may embody or implement a method of implementing a method for determining modified protection volumes, including for implementing example technique 700 as described with reference to FIG. 17. Various illustrative aspects of the disclosure are described above. These and other aspects are within the scope of the following claims.

What is claimed is:

1. A system comprising:

a transceiver configured to receive surveillance data from a vehicle;

one or more processors configured to:

determine a location of the vehicle based at least in part on the received surveillance data;

determine a course of the vehicle based at least in part on the received surveillance data;

predict a future vehicle maneuver for the vehicle based at least in part on the location of the vehicle and the course of the vehicle, and based at least in part on a set of protocol data indicating one or more standard procedures for one or more vehicle maneuvers, wherein the set of protocol data is associated with a certain region and the one or more standard procedures are followed by vehicles operating within the certain region;

determine, based at least in part on the predicted future vehicle maneuver, a modified protection volume for the vehicle that is modified relative to a baseline protection volume for the vehicle; and generate an output based on the modified protection volume.

2. The system of claim 1, wherein the location is a first location, the course is a first course, the output is a first output, and the one or more processors are configured to determine the first location and the first course at a first time, and wherein the one or more processors are further configured to:

determine a second course of the vehicle at a second time;

determine a second location of the vehicle at the second time;

determine, based at least in part on the second course of the vehicle and the second location of the vehicle, that the vehicle has started the predicted future vehicle maneuver;

switch from generating an output based on the modified protection volume to generating an output based on the baseline protection volume based at least in part on determining that the vehicle has started the predicted future vehicle maneuver; and generate a second output based on the baseline protection volume.

3. The system of claim 1, wherein the one or more processors are further configured to:

determine the course of the vehicle by at least determining a course of the vehicle relative to a runway based at least in part on the received surveillance data; and determine the location of the vehicle by at least determining a location of the vehicle relative to the runway based at least in part on the received surveillance data.

4. The system of claim 3, wherein the one or more standard procedures comprises an airfield traffic pattern, and the predicted future vehicle maneuver comprises a turn, and wherein the one or more processors are configured to:

determine that the vehicle has passed an end of the runway;

determine that the vehicle has not started the predicted future vehicle maneuver; and determine the modified protection volume with a larger horizontal dimension than the baseline protection volume based at least in part on determining that the vehicle has passed the end of the runway and has not started the predicted future vehicle maneuver.

5. The system of claim 3, wherein the one or more standard procedures comprises an airfield traffic pattern, and the predicted future vehicle maneuver comprises a decrease in altitude, and wherein the one or more processors are configured to:

determine that the vehicle has passed an end of the runway;

determine that the vehicle has not started the predicted future vehicle maneuver; and determine the modified protection volume with a larger vertical dimension than the baseline protection volume based at least in part on determining that the vehicle has passed the end of the runway and has not started the predicted future vehicle maneuver.

6. The system of claim 1, wherein the one or more standard procedures comprises a takeoff, and the predicted future vehicle maneuver comprises an increase in altitude, and wherein the one or more processors are configured to:

determine a horizontal velocity of the vehicle;

determine that the horizontal velocity of the vehicle exceeds a threshold horizontal velocity;

determine that the vehicle has not started the predicted future vehicle maneuver; and determine the modified protection volume with a larger vertical dimension than the baseline protection volume based at least in part on determining that the horizontal velocity of the vehicle exceeds the threshold horizontal velocity.

7. The system of claim 1, wherein the vehicle comprises a helicopter, the one or more standard procedures comprises a takeoff, and the predicted future vehicle maneuver comprises an increase in horizontal velocity, and wherein the one or more processors are configured to:

determine a vertical velocity of the vehicle;

determine that the vertical velocity of the vehicle exceeds a threshold vertical velocity;

determine that the vehicle has not started the predicted future vehicle maneuver; and determine the modified protection volume with a larger horizontal dimension than the baseline protection volume based at least in part on determining that the horizontal velocity of the vehicle exceeds the threshold vertical velocity.

8. The system of claim 1, wherein the one or more standard procedures comprises a turn during cruise, and the predicted future vehicle maneuver comprises a change in altitude, and wherein one or more processors are configured to:

determine that the course of the vehicle has changed relative to magnetic north; and determine the modified protection volume with a larger vertical dimension than the baseline protection volume based at least in part on determining that the course of the vehicle has changed relative to magnetic north.

9. The system of claim 1, wherein the output comprises an alert in response to a second vehicle being detected inside the modified protection volume.

10. The system of claim 1, wherein the vehicle is a first vehicle, and wherein the one or more processors are further configured to:

predict a trajectory for a second vehicle;

propagate the trajectory for the second vehicle; and generate the output by at least generating an alert indicating that the propagated trajectory for the second vehicle is on course to enter the modified protection volume.

11. The system of claim 1, wherein the one or more processors are further configured to determine a current vehicle maneuver for the vehicle based at least in part on the location of the vehicle and the course of the vehicle, wherein the system is configured to predict the future vehicle maneuver for the vehicle based at least in part on the current vehicle maneuver for the vehicle.

12. The system of claim 1, wherein the one or more processors are further configured to:

determine an acceleration of the vehicle based at least in part on the received surveillance data;

propagate a trajectory of the vehicle based at least in part on the predicted future vehicle maneuver and on the acceleration of the vehicle; and determine, based at least in part on the propagated trajectory of the vehicle, a modified protection volume for the vehicle that is modified relative to the baseline protection volume for the vehicle.

13. A method comprising:

receiving surveillance data from a vehicle;

determining a location of the vehicle based at least in part on the received surveillance data;

determining a course of the vehicle based at least in part on the received surveillance data;

predicting a future vehicle maneuver for the vehicle based at least in part on the location of the vehicle and the course of the vehicle, and based at least in part on a set of protocol data indicating one or more standard procedures for one or more vehicle maneuvers, wherein the set of protocol data is associated with a certain region and the one or more standard procedures are followed by vehicles operating within the certain region;

determining, based at least in part on the predicted future vehicle maneuver, a modified protection volume for the vehicle that is modified relative to a baseline protection volume for the vehicle; and generating an output based on the modified protection volume.

14. The method of claim 13, wherein the location is a first location, the course is a first course, the output is a first output, and the one or more processors are configured to determine the first location and the first course at a first time, the method further comprising:

determining a second course of the vehicle at a second time;

determining a second location of the vehicle at the second time;

determining, based at least in part on the second course of the vehicle and the second location of the vehicle, that the vehicle has started the predicted future vehicle maneuver;

switching from generating an output based on the modified protection volume to generating an output based on the baseline protection volume based at least in part on determining that the vehicle has started the predicted future vehicle maneuver; and generating a second output based on the baseline protection volume.

15. The method of claim 13, further comprising:

determining the course of the vehicle by at least determining a course of the vehicle relative to a runway based at least in part on the received surveillance data; and determining the location of the vehicle by at least determining a location of the vehicle relative to the runway based at least in part on the received surveillance data, wherein:

the one or more standard procedures comprises an airfield traffic pattern;

the predicted future vehicle maneuver comprises a turn; and the method further comprising:

determining that the vehicle has passed an end of the runway;

determining that the vehicle has not started the predicted future vehicle maneuver; and determining the modified protection volume with a larger horizontal dimension than the baseline protection volume based at least in part on determining that the vehicle has passed the end of the runway and has not started the predicted future vehicle maneuver.

16. The method of claim 13, further comprising:

determining the course of the vehicle by at least determining a course of the vehicle relative to a runway based at least in part on the received surveillance data; and determining the location of the vehicle by at least determining a location of the vehicle relative to the runway based at least in part on the received surveillance data, wherein:

the one or more standard procedures comprises an airfield traffic pattern;

the predicted future vehicle maneuver comprises a decrease in altitude; and the method further comprising:

determining that the vehicle has passed an end of the runway;

determining that the vehicle has not started the predicted future vehicle maneuver; and determining the modified protection volume with a larger vertical dimension than the baseline protection volume based at least in part on determining that the vehicle has passed the end of the runway and has not started the predicted future vehicle maneuver.

17. The method of claim 13, wherein:

the one or more standard procedures comprises a takeoff;

the predicted future vehicle maneuver comprises an increase in altitude; and the method further comprising:

determining a horizontal velocity of the vehicle;

determining that the horizontal velocity of the vehicle exceeds a threshold horizontal velocity;

determining that the vehicle has not started the predicted future vehicle maneuver; and determining the modified protection volume with a larger vertical dimension than the baseline protection volume based at least in part on determining that the horizontal velocity of the vehicle exceeds the threshold horizontal velocity.

18. The method of claim 13, wherein:

the one or more standard procedures comprises a turn during cruise;

the predicted future vehicle maneuver comprises a change in altitude;

the method further comprises:

determining that the course of the vehicle has changed relative to a magnetic north; and determining the modified protection volume with a larger vertical dimension than the baseline protection volume based at least in part on determining that the course of the vehicle has changed relative to the magnetic north.

19. A system comprising:

means for receiving surveillance data from a vehicle;

means for determining a location of the vehicle based at least in part on the received surveillance data;

means for determining a course of the vehicle based at least in part on the received surveillance data;

means for predicting a future vehicle maneuver for the vehicle based at least in part on the location of the vehicle and the course of the vehicle, and based at least in part on a set of protocol data indicating one or more standard procedures for one or more vehicle maneuvers, wherein the set of protocol data is associated with a certain region and the one or more standard procedures are followed by vehicles operating within the certain region;

means for determining, based at least in part on the predicted future vehicle maneuver, a modified protection volume for the vehicle that is modified relative to a baseline protection volume for the vehicle; and means for generating an output based on the modified protection volume.

20. The system of claim 19, wherein the location is a first location, the course is a first course, the output is a first output, and the one or more processors are configured to determine the first location and the first course at a first time, the system further comprising:

means for determining a second course of the vehicle at a second time;

means for determining a second location of the vehicle at the second time;

means for determining, based at least in part on the second course of the vehicle and the second location of the vehicle, that the vehicle has started the predicted future vehicle maneuver;

means for switching from generating an output based on the modified protection volume to generating an output based on the baseline protection volume based at least in part on determining that the vehicle has started the predicted future vehicle maneuver; and means for generating a second output based on the baseline protection volume.

* * * * *